US005685482A

United States Patent [19]

Sickles

[11] Patent Number: 5,685,482

[45] Date of Patent: Nov. 11, 1997

[54] INDUCTION SPRAY CHARGING APPARATUS

[76] Inventor: James E. Sickles, 21889 Potomac Dr., Southfield, Mich. 48076

[21] Appl. No.: 425,737

[22] Filed: Apr. 20, 1995

Related U.S. Application Data

[63] Continuation-in-part of Ser. No. 103,212, Aug. 9, 1993, Pat. No. 5,409,162.

[51] Int. Cl.[6] ..... B05B 5/043

[52] U.S. Cl. ..... 239/3; 239/690.1; 239/698; 239/705; 239/707; 239/296; 239/300; 239/416.5; 239/522

[58] Field of Search ..... 239/3, 690, 690.1, 239/697–700, 702–708, 290, 296, 300, 301, 416.5, 417, 522, 523

[56] References Cited

U.S. PATENT DOCUMENTS

| | | | |
|---|---|---|---|
| 2,302,185 | 7/1942 | Campbell . | |
| 2,766,064 | 10/1956 | Schweitzer | 239/699 |
| 3,093,309 | 6/1963 | Watanabe . | |
| 3,371,145 | 2/1968 | Senay . | |
| 3,408,985 | 11/1968 | Sedlacsik . | |
| 3,425,625 | 2/1969 | Probst . | |
| 3,653,592 | 4/1972 | Cowan . | |

(List continued on next page.)

FOREIGN PATENT DOCUMENTS

| | | | |
|---|---|---|---|
| 1125358 | 6/1982 | Canada | 239/690.1 |

OTHER PUBLICATIONS

Improving Liquid Spray Transfer Efficiency, Glen L. Muir, Graco Inc. Minneapolis, MN Mar. 1995, pp. 63–67.

Spraying Water–Borne Coating Electrostatically, Jim Scharfenberger, Manager, Process Tech., Indianapolis, IN, Jan. 1989, pp. 48–56.

Should You Consider Air–Assisted Airless Spray?, Mike Osborne and John Treuschel, The DeVilbiss Co., Toledo, OH, Jan. 1989, pp. 59–64.

Trends in Electrostatic Hand Guns, David c. Burdakin, Product Manager Ransburg Electrostatic Equipment, Inc. Indianapolis, IN, Mar. 1987, pp. 86–93.

Spray Painting Equipment, Products Finishing, Mar. 1987, pp. 79–85.

Charge to Mass Distributions in Electrostatic Sprays, T.C. Anestos, J.E. Sickles, R.M. Tepper, IEEE Transaction on Industry Applications, vol. IA–13, No. 2, Mar./Apr. 1977, pp. 168–177.

Specific Charge Measurements in Electrostatic Air Sprays, J.E. McCarthy, Jr. and D.W. Senser, Thermal Sciences and Propulsion Center School of Mechanical Engineering, Purdue University, West Lafayette, IN, pp. 1–6.

Electrostatic Atomisation of Conducting Liquids Using AC Superimposed on DC Fields. W. Balachandran, W. Machowski, and C.N. Ahmad, Dept. of Electronic and Electrical Engineering, University of Surrey Guildford, Surrey GU2 5XH, U.K., pp. 1369–1373.

*Primary Examiner*—Lesley D. Morris
*Attorney, Agent, or Firm*—Jones, Tullar & Cooper, P.C.

[57] ABSTRACT

Induction charging apparatus for HVLP spray guns and air-assisted airless spray guns includes an air cap having a central orifice for receiving a spray gun nozzle. The cap includes one or more charging electrodes adjacent the orifice and carrying a voltage sufficiently large to induce on the spray droplets charges of a polarity opposite to that on the electrodes. A rotatable electrical connector enables the cap to rotate 360° while maintaining electrical connections between the electrodes and a power supply. The spray gun nozzle is an airless nozzle receiving liquid at a pressure of about 1,000 psi and having a spray tip from which liquid is sprayed along a flow path coaxial with the electrodes. Air at less than about 10 psi is directed along the flow path to assist in the atomization of the liquid from the airless nozzle.

41 Claims, 10 Drawing Sheets

U.S. PATENT DOCUMENTS

| | | | |
|---|---|---|---|
| 3,677,470 | 7/1972 | Probst et al. | 239/707 |
| 3,698,634 | 10/1972 | Hamilton . | |
| 3,737,090 | 6/1973 | Wech . | |
| 3,767,115 | 10/1973 | Kozinski et al. . | |
| 3,815,820 | 6/1974 | Probst . | |
| 3,843,052 | 10/1974 | Cowan . | |
| 3,907,202 | 9/1975 | Binoche . | |
| 3,937,401 | 2/1976 | Luderer et al. . | |
| 4,002,777 | 1/1977 | Juvinall et al. | 239/3 X |
| 4,009,829 | 3/1977 | Sickles | 239/690.1 |
| 4,055,300 | 10/1977 | Binoche . | |
| 4,073,002 | 2/1978 | Sickles et al. | 239/690.1 X |
| 4,106,697 | 8/1978 | Sickles et al. . | |
| 4,120,017 | 10/1978 | Sickles . | |
| 4,186,886 | 2/1980 | Sickles | 239/690.1 |
| 4,214,709 | 7/1980 | Scull et al. . | |
| 4,219,157 | 8/1980 | Binoche . | |
| 4,232,824 | 11/1980 | Binoche . | |
| 4,238,077 | 12/1980 | Hori . | |
| 4,245,784 | 1/1981 | Garcin . | |
| 4,248,386 | 2/1981 | Morle . | |
| 4,255,777 | 3/1981 | Kelly . | |
| 4,258,655 | 3/1981 | Bagby et al. . | |
| 4,258,885 | 3/1981 | Legeza . | |
| 4,266,721 | 5/1981 | Sickles | 239/3 |
| 4,290,091 | 9/1981 | Malcolm . | |
| 4,313,968 | 2/1982 | Sickles et al. . | |
| 4,331,298 | 5/1982 | Bentley et al. . | |
| 4,341,347 | 7/1982 | DeVittorio . | |
| 4,341,815 | 7/1982 | Bagby et al. . | |
| 4,343,433 | 8/1982 | Sickles | 239/3 |
| 4,347,984 | 9/1982 | Sickles | 239/690.1 |
| 4,355,764 | 10/1982 | Rood et al. . | |
| 4,377,603 | 3/1983 | Itoh et al. . | |
| 4,381,533 | 4/1983 | Coffee . | |
| 4,440,349 | 4/1984 | Sickles . | |
| 4,476,515 | 10/1984 | Coffee . | |
| 4,572,438 | 2/1986 | Traylor . | |
| 4,598,871 | 7/1986 | Hartle . | |
| 4,611,762 | 9/1986 | Turner et al. . | |
| 4,613,075 | 9/1986 | Owen . | |
| 4,721,255 | 1/1988 | Lind | 239/690 |
| 4,745,520 | 5/1988 | Hughey . | |
| 4,752,034 | 6/1988 | Kuhn et al. . | |
| 4,761,299 | 8/1988 | Hufstetler et al. . | |
| 4,819,879 | 4/1989 | Sharpless et al. . | |
| 4,842,203 | 6/1989 | Kuhn et al. | 239/708 |
| 4,911,367 | 3/1990 | Lasley | 239/707 X |
| 4,915,303 | 4/1990 | Hufgard . | |
| 5,044,564 | 9/1991 | Sickles | 239/690.1 |
| 5,090,619 | 2/1992 | Barthold et al. | 239/417 X |
| 5,090,623 | 2/1992 | Burns et al. . | |
| 5,178,330 | 1/1993 | Rodgers . | |
| 5,188,290 | 2/1993 | Gebauer et al. . | |
| 5,222,663 | 6/1993 | Noakes et al. | 239/690 X |

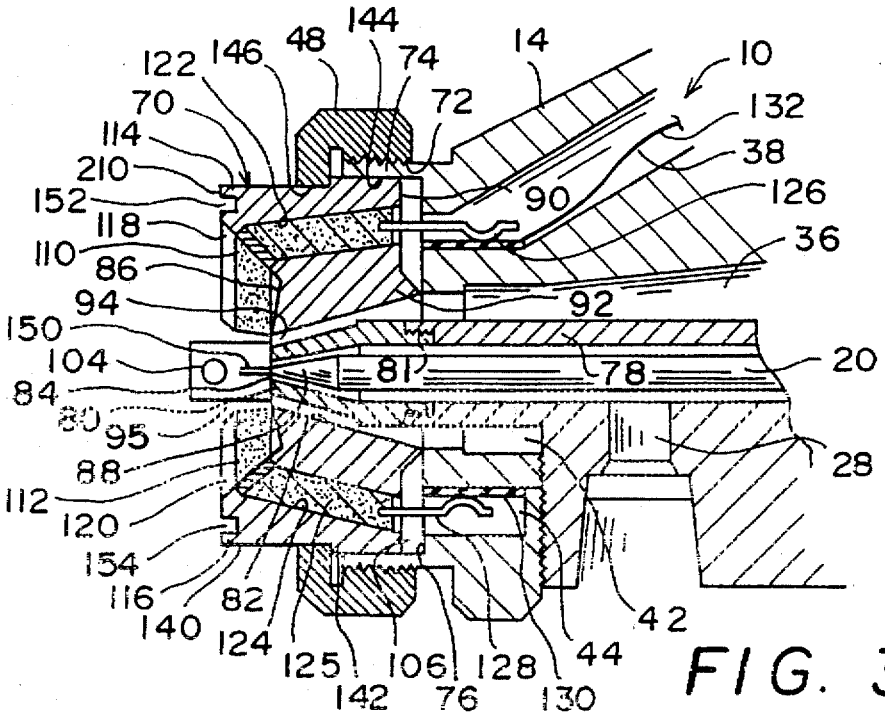
FIG. 3
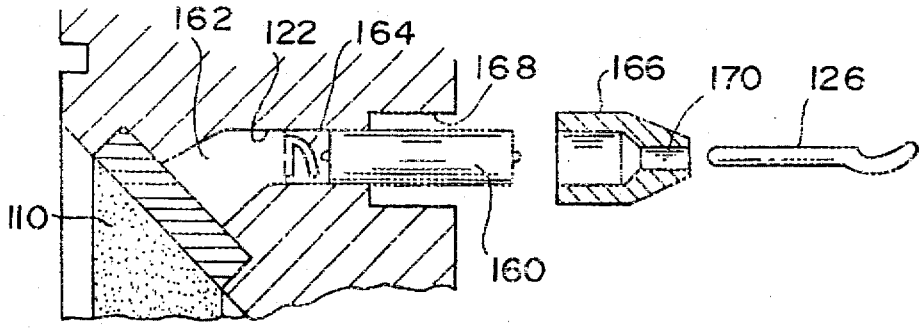
FIG. 4
FIG. 6
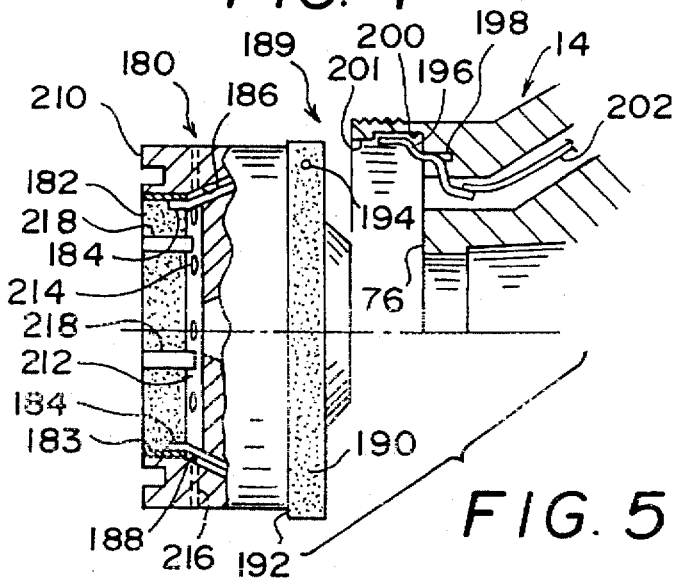
FIG. 5
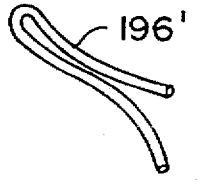
FIG. 7
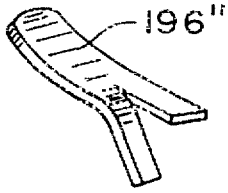

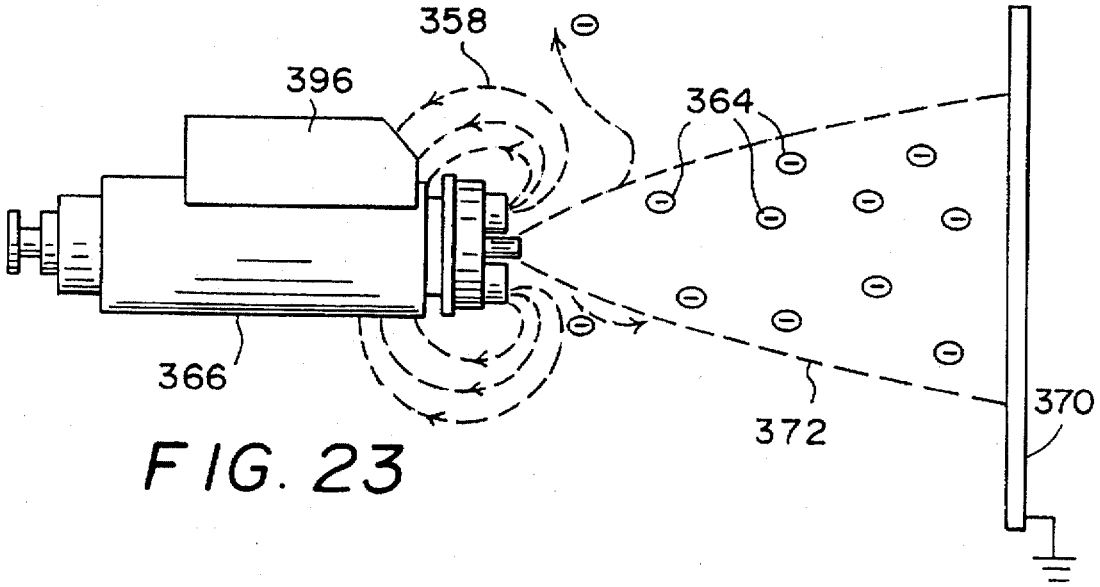
FIG. 23
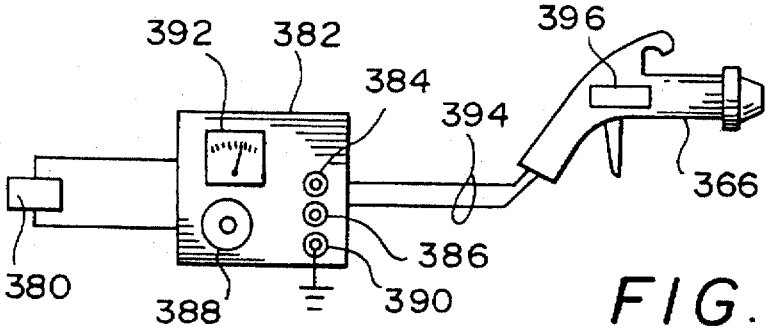
FIG. 24
FIG. 25
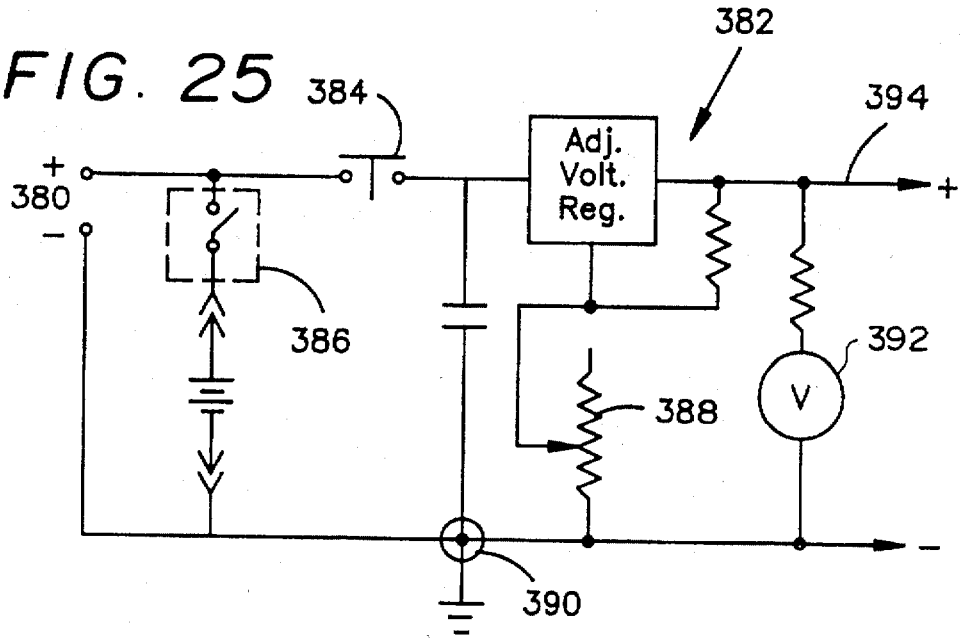

INDUCTION SPRAY CHARGING APPARATUS

The present application is a continuation-in-part of U.S. application Ser. No. 08/103,212 of James E. Sickles, filed Aug. 9, 1993, now U.S. Pat. No. 5,409,162, issued Apr. 25, 1995.

BACKGROUND OF THE INVENTION

The present invention relates, in general, to an improved spray gun for producing charged fluid particle sprays, and more particularly to induction charging apparatus for high volume, low pressure fluid spray devices and for air-assisted airless fluid spray devices, and to methods for inducing charges on atomized fluid particles.

This invention is related to that disclosed in U.S. Pat. No. 5,044,564 issued to James E. Sickles on Sep. 3, 1991, the disclosure of which is incorporated herein by reference.

There are three basic atomization methods for producing liquid sprays, air spray, airless spray, and rotary atomization. Air spray utilizes the energy in flowing air, in the form of air pressure and volume directed against a fluid, to atomize a liquid. Liquid volume and viscosity determine the amount of energy needed to obtain a desired atomization level. Because of the nature of the air/liquid interface, the air spray process atomizes a liquid to produce a wide range of particle sizes. As the air energy increases, average particle size decreases. Because particles smaller than 20 microns tend to become airborne and create overspray, transfer efficiency of a liquid to a target can be low.

A high volume low-pressure (HVLP) air spray, which typically limits the air energy to a maximum of about 10 psi, will yield an increase in transfer efficiency. However, either the quantity of liquid flow or the liquid viscosity must be lowered to achieve the same level of finish quality. Further difficulty is encountered because of the current trend toward reduction of solvents in coatings, such as paint, which results in increased viscosity. This has resulted in a reduced fluid delivery capacity for HVLP sprays, although this is somewhat offset by an increased transfer efficiency.

Airless sprays utilize high pressure (2000–3000 psi) liquids which are forced through a small orifice to produce a sheet of liquid. This sheet reacts with the atmosphere to cause a folding or oscillation of the sheet to break off small liquid droplets. High pressures are required to produce a full, complete pattern. Further, the resulting atomization is coarser than air spray or HVLP, but the droplets move at a high velocity, fluid delivery is high, transfer efficiency is high in applications to large surfaces, and since few small particles result, overspray is low.

Air-assisted airless sprays utilize an air cap to provide additional energy for pattern control, permitting, in effect, an airless spray at a reduced liquid pressure with a completed spray pattern. This gives a reduced particle velocity and lower fluid delivery rate than an airless spray with better efficiency than a pure air spray. Efficiency is usually equal to HVLP, and finish quality is better than with airless spray, and this process fills the gap for products that are large enough to require a large amount of spray material and high production rates, while still providing a high quality finish.

Rotary atomization is a special method usually used in automated finishing. A rotating disk or plate carries the liquid, which is carried to the edge of the disk by rotation. The coating is atomized as it leaves the disk.

In general, conventional airless, air assisted, or air atomization spray guns incorporate a spray cap having a liquid spray nozzle, the nozzle portion of the cap including liquid passageways and one of the mechanisms described above for atomizing a liquid such as paint. In such devices, the liquid typically flows under pressure or is siphoned through a central passageway in the spray cap for discharge through a central outlet orifice. This liquid flow is typically controlled by a flow control needle valve located in the central passageway, and the size of the orifice and the pressure of the liquid is selected so that the liquid is atomized as it is discharged. In an air assisted or an air atomized spray gun, air outlets are provided near the central liquid orifice to assist in this atomization and to control the direction and flow pattern of the resulting liquid particles or droplets. Thus, air under pressure may be supplied coaxially with liquid being ejected from a central liquid outlet orifice to assist in atomizing the liquid and to impel the droplets outwardly away from the spray gun nozzle. This air flow typically is through a single annular orifice surrounding the liquid outlet, although additional air outlet orifices may be provided at locations spaced outwardly from the liquid outlet. In addition, air may be supplied by a pair of forwardly projecting air horns mounted on the spray cap, the air horns incorporating additional air outlets directed generally inwardly toward the axis of the atomized spray to control its pattern. Typically, these air horns shape the atomized spray into a fan pattern to facilitate operation of the spray gun, with the air cap being positioned on the spray gun to provide, for example, a vertical fan pattern or a horizontal fan pattern.

The use of such conventional spray guns for spraying materials such as paint having a high solids content creates problems, as noted above, since such spray guns have low transfer efficiencies, in the range of 15 to 30% for an air-atomized paint spray. Increased efficiency has been obtained through electrostatic charging of the atomized coating material. As is known, electrostatics can be applied to any form of atomization. Typically this is done by emitting corona ions while the liquid is being atomized. Some of the ions attach themselves to the droplets to give them an excess charge of one polarity so that when the target is grounded the charged particles will be a attracted to the target. This attraction reduces overspray, thereby increasing the efficiency to the range of 45 to 75% for electrostatic air atomized spray devices and from 90 to 99% for electrostatic rotary bell spray devices. However, even electrostatic devices present problems, particularly when spraying a conductive liquid such as water-based paint, for it is necessary to electrically isolate such a system to prevent high voltages from endangering users or causing electrical discharges which could result in fires or explosions. Various techniques have been provided for producing the necessary isolation, but difficulties have been encountered in each such system.

Most prior electrostatic air spray or air-assisted spray devices have in common a spray gun to which is mounted a high voltage electrode disposed adjacent the spray discharge point or, more commonly, in direct contact with the liquid stream itself. Such electrodes typically carry an electrical potential in the neighborhood of 50 to 85 KV, and in some instances as high as 150 KV. Such a device is illustrated, for example, in U.S. Pat. No. 4,761,299, where a voltage on the order of 100 KV is applied between the spray gun electrode and the article being sprayed. In addition to providing high voltage contact (or conduction) charging of the spray droplets by direct physical contact of the liquid with the electrodes, the electric field produced by this voltage creates a corona effect; that is it produces a region rich in gaseous ions through which the spray particles must pass so that some of the ions become attached to the particles. This results in electric charges on the particles of the same polarity as that of the high voltage electrode, causing them, together with copious quantities of free, unattached ions, to migrate toward the grounded workpiece. It has been found that the free ion current deposited on a grounded target can be up to several times that deposited by charged spray particles.

Such electrostatic, or corona effect, devices encounter numerous difficulties, not only because of the very high voltages required to produce effective operation, but because a significant part of the current between the spray gun and the target, or workpiece, is due to free ions, rather than charged particles, thereby reducing transfer efficiency. The high voltages are a problem because they require large, heavy and relatively expensive power supplies and because the cable interconnecting the power supply and the spray gun charging electrode necessarily has to be heavily insulated, making it bulky, relatively inflexible, and expensive. The size and weight of the power supply and its cable substantially restricts the usefulness of conventional corona effect spray guns.

Various attempts have been made to overcome the power supply problem of such high voltage devices, but with limited success. The use of high voltages, furthermore, is hazardous not only because of the possibility of creating electrical arcing when the gun is moved near grounded objects, but because of the danger to the operator if the electrode is inadvertently touched. Furthermore, the high voltages used in such systems create a current flow of excess ions travelling to nearby objects, in addition to the target, resulting in an undesired charge build-up on such nearby objects if they are not adequately grounded. The hazard of sparking and consequent fire exists when the operator or some other grounded object is brought close to such a charged object. Further, the migration of such charges causes an undesired build-up of the charged spray particles on objects other than the workpiece.

SUMMARY OF THE INVENTION

An effective way to eliminate the need for the very high voltages (used in corona discharge devices) is through the use of induction charging, wherein an atomized spray is formed in the presence of a static electric field which has an average potential gradient in the range of about 5 to 30 KV per inch. In such devices, the spacing between the liquid and the source of potential is made sufficient to prevent an electrical discharge so that a capacitive effect produces the required static field. This field induces on liquid particles produced within the field electric charges having a polarity which is opposite to that of the applied voltage. The resulting charged particles can then be directed toward a target, or work piece, to provide the desired coating. Such induction charging techniques have been found to be particularly useful in spray systems utilizing electrically conductive liquids such as water based paints, since the liquid supply can be electrically grounded, as opposed to the high voltage devices described above, wherein the liquid is at the high voltage of the discharge electrode. Although the target in an induction spray system is normally grounded, it has been found that such induction charging apparatus is also capable of coating a nonconductive work piece with a conductive paint, while achieving good "wrap around" and a smooth, even surface.

The present invention relates to an improved induction charging apparatus for automatic or hand held spray guns, and in particular to induction charging apparatus for HVLP spray devices and for air-assisted airless spray devices. The induction charging apparatus includes an induction charging air cap having a central aperture which receives a spray gun liquid spray nozzle. The air cap carries curved electrodes which are mounted on the front of the cap and extend forwardly of, and are generally concentric with the nozzle. The cap may also include air passageways to supply air through corresponding air exit openings, or orifices, located around the nozzle.

The curved electrodes preferably extend generally circumferentially around at least part of the forward face of the air cap, and are located on the inner surface of a forwardly extending electrode support portion so that the electrode surfaces are generally parallel to the spray axis to produce an electric field in the spray particles in front of the nozzle. This electric field induces charges in the atomized liquid particles ejected from the spray gun orifice, the charges having a polarity opposite to the polarity of the voltage supplied to the electrodes. The induction charging air cap includes connectors for the curved electrodes to allow connection of these electrodes to a suitable power supply carried by or connected to the spray gun.

The electrodes can be formed as a conductive or semiconductive layer or coating on the inner surface of the electrode support portion of the air cap. Alternatively, the electrode can be a separate element or elements secured to the electrode support, as by adhesives or other fasteners, can be molded into plastic support elements which are then secured to the face of the air cap, or can be molded into the air cap itself when the air cap is fabricated from molded plastic material. The inner surface of the electrode support can be cylindrical or conical, and the electrode can be a single piece surrounding the nozzle and coaxial therewith, or can be segmented into multiple pieces. In a preferred form, the electrode support consists of a pair of diametrically opposed generally semicircular segments carrying corresponding generally semicircular electrodes.

The atomization of the liquid spray and the pattern of the spray droplets discharged from the nozzle through the electric field produced by the electrodes may be controlled by air flow through the air cap. For example, the air cap may incorporate two diametrically opposed air horns, each including air outlet apertures which direct a flow of air under pressure inwardly against the spray droplets. The air horns may be located between electrode segments and may be spaced from adjacent electrode segments to additionally provide generally radial flow paths through the air cap walls to permit ambient air around the exterior of the air cap to flow at ambient pressure into the interior of the electrode supports and into the droplet flow path.

If desired, one or more additional generally radial air paths may be provided through the air cap, leading to the inner surface of the electrode support (or supports) from the exterior of the air cap to allow aspiration of ambient air into the droplet flow path.

The air cap as described above may be used in an HVLP induction spray apparatus, as described above, or in an air-assisted airless spray apparatus. When the air cap is used with an airless spray gun having a high pressure liquid nozzle to provide the air-assisted airless induction spray device, the electrodes carried by the air cap are the same as those used with the HVLP embodiment described above to provide induction charging on the spray particles. However, the particles are produced, in the air-assisted airless embodiment, by ejecting a liquid stream from the nozzle under higher pressure than is needed for the HVLP operation; for example up to about 1,500 psi. The air-assisted airless nozzle incorporates an orifice which is sized to accommodate the viscosity of the liquid being sprayed, typically 0.005 to 0.045 inches in diameter, with an outlet tip which is shaped to produce a desired spray pattern. Atomization and shaping of a fan of spray of particles ejected from a nozzle may be assisted by a flow of air through axially-directed apertures surrounding the nozzle tip, by air flow from air passageways in the air cap or in air horns on the cap, or by both, to thereby provide air-assisted airless spraying. The electrodes carried by the air cap surrounding the nozzle, described above, induce charges on the sprayed particles.

The term "air cap" as used herein refers to a cap which is secured to a spray gun. Such a cap conventionally incorporates one or more air horns or other air passages through the body of the cap for directing a flow or flows of air to control the spray pattern produced by the spray gun, but in the present invention it is primarily used to support one or more electrodes close to the spray axis for the purpose of inductively charging the spray particles. The cap preferably also incorporates air horns or other air flow passages to assist in the atomization of the liquid spray and to control its pattern, and thus is conveniently referred to as an air cap, but it should be understood that the "air cap" does not necessarily include such air passages.

The air cap preferably is secured to a conventional hand held or automatic spray gun by means of a standard internally threaded retainer ring which engages external threads on the gun. The air cap is rotatable 360° with respect to the spray gun in a plane perpendicular to the axis of the fluid exit orifice of the spray gun nozzle and can be fixed at any desired rotational angle by tightening the retainer. For air-assisted spraying, air flow passageways within the spray gun are formed with annular chambers and/or closely spaced parallel passageways at the front face of the gun which cooperate with corresponding chambers or passageways in the air cap at any angular position of the cap so as to allow 360° adjustment of the location of the electrodes and any air horns while maintaining the air flow. Electrical connectors are provided by which the electrodes on the cap are connected through wires in the spray gun to a power supply, the connectors being rotatable so that connection is made at any rotational angle of the cap. Such rotatable connectors preferably include an annular contact surface on one of the relatively movable cap and spray gun and further include at least one wiper, preferably in the form of a spring contact, on the other of the relatively movable parts, whereby contact is maintained at any angle.

The liquid nozzle in either an HVLP or an air-assisted airless spray gun includes a flow control needle which is movable axially within a nozzle central liquid flow orifice, the needle serving as a valve to regulate the rate of flow of the liquid being sprayed. In some embodiments it may be desirable to provide a thin needle extension which extends through the liquid flow orifice a short distance; for example, about ¼ inch beyond the face of the air cap, to provide a corona discharge point or to enhance the induction charging of atomized liquid particles. In another embodiment of the invention, the needle may be slightly curved or spade-shaped to form a paddle, and mounted on a rotary shaft for rotation in the path of exiting liquid particles or droplets to assist in atomization and charging of the fluid droplets.

In still another embodiment of the invention, the liquid flow control needle may be hollow so that air under pressure may flow through it and exit from it just forward of the liquid exit orifice to thereby distribute atomized droplets generally radially outwardly for improved charge acquisition. A deflector may be incorporated at the outlet end of the hollow needle for improved distribution of the droplets. A similar effect can be obtained by vibrating the needle laterally within the liquid flow passageway.

In the air-assisted airless spray gun of the present invention, the liquid flow control needle has a semi-spherical head which is sealable in a corresponding valve seat ring having a semi-spherical valve seat surrounding an axial fluid passage. A nozzle spray tip is axially aligned with the valve seat ring, and includes an axial orifice which is aligned with the axial fluid passage in the valve seat ring and which terminates in an exit aperture. The exit aperture can be shaped to spread the liquid spray from the nozzle in a desired pattern as the spray passes through the air cap and thus through the induction electrodes.

The diameters of the axial fluid passage through the valve seat and the axial orifice through the spray tip for the airless nozzle are selected in accordance with the viscosity of the fluid being sprayed and the pressure at which it is being sprayed. The atomization of the liquid spray is assisted by a flow of air through the air cap and generally coaxial with the nozzle and/or by a flow of pressurized air directed at and impinging on the liquid spray, as from air horns.

HVLP spray guns, such as the gun described in U.S. Pat. No. 5,178,330, typically have exit air pressures at or below about 10 psig with a flow rate of about 5–60 cubic feet per minute. Although such HVLP spray guns have numerous advantages, notably significantly enhanced application efficiency, in some cases HVLP devices have difficulty producing the fine liquid atomization of high pressure air atomized systems. As a result, HVLP devices have, in the past, experienced lower average droplet charge-to-mass ratios than are attained with high pressure systems. In addition, low pressure systems often allow lower attractive forces to deflect charged droplets back to the spray gun. However, because of the other advantages of HVLP devices they can, in the combination of the present invention, provide significant advances over other systems. Accordingly, in one embodiment of the present invention a low induction voltage, in the range of 5–10 KV, is used in combination with the HVLP system, with the spray gun body and an axial flow control needle valve in the spray gun nozzle being electrically grounded so that the spray gun is safe for an operator to handle. The induction voltage is applied only to electrodes on an air cap surrounding the nozzle and coaxial with the nozzle outlet orifice to produce an electric field in the droplet flow path between the electrodes and the flow control needle. The electric field also extends between the electrodes and the spray gun exteriorly of the air cap. The voltage in the range of about 5–10 KV contrasts with voltages in the range of 80 to 150 KV used by prior electrostatic spray guns. A resistor is connected between the electrode power supply and the electrode itself to prevent excessive current flow in the event one of the electrodes becomes short circuited and a shunt resistor to ground is provided to allow charges on the electrodes to drain to ground when the power supply is switched off.

In the normal operating mode of the device of the HVLP induction charging device, low pressure air flowing from an air exit orifice (or orifices) surrounding the central nozzle outlet orifice is adjusted to have a volume and flow rate which cooperates with the pressure and flow rate of the liquid from the nozzle to atomize the liquid exiting from this orifice. This atomization of the liquid occurs in the electric field produced by the electrodes so that during the formation of atomized droplets electrical charges are induced in them.

These charges are not produced by ionization, and accordingly, the spray has a net electrical polarity on each droplet which is opposite to that of the voltage applied to the electrodes. Thus, if the voltage applied to the electrodes is positive with respect to the neutral ground potential of the needle, the charge induced on the fluid droplets will be negative. Similarly, if the charge applied to the electrodes is negative with respect to ground, the induced charge will be positive. Although this is the normal and preferred mode of operation of the present device, it is noted that it may at times be desirable, as when a low conductivity liquid is to be sprayed, to increase the voltage somewhat, for example to about 12 KV or even more, and to utilize a needle extension from the control valve needle into the flow path to facilitate a corona discharge which will further add to the charging of the liquid.

The foregoing induction process is also advantageous when used in combination with an air-assisted airless spray gun. In accordance with this embodiment of the invention, the induction air cap described above is mounted on a typical air-assisted spray gun to provide an induction field around the high pressure liquid nozzle used in such spray guns. Atomization of the liquid, which in such guns is primarily due to liquid pressure, occurs in the induction field in front of the nozzle outlet orifice so that during the formation of atomized droplets electrical charges are induced on them. As described above, air outlet ports may surround the nozzle to produce a generally axial air flow to assist in atomization, thereby permitting a reduction in liquid pressure. Additional air outlets may be provided in the air cap, for example in air horns, to direct air generally radially inwardly toward the axis of the liquid spray to further atomize the liquid and to shape the spray pattern.

The electric field produced by the electrodes is confined to the spray gun head, with the target being grounded so that under normal operating conditions no particle depositing potential gradient or electric field exists between the spray gun and the target. Because no depositing field is required, the device of the present invention substantially reduces the likelihood of arcing and provides a significant safety factor to the operator. Instead of relying on a high voltage to cause particles to travel to a target, the invention produces a "cloud" of charged particles which are directed toward the target by air flow. When the particles reach the target, they form a thin, even coating thereon. Thus, the airflow directs the cloud of charged particles to a target without the need for a high potential between the gun and the target and without adding free ions to the spray cloud.

Although the present invention is described in terms of HVLP or air-assisted airless spray guns, it will be understood that the air cap can be used with air atomized spray guns at air flows and pressures outside HVLP specifications, provided that air turbulence near the exit orifice of the spray cap is maintained below the point where a significant quantity of the liquid being sprayed accumulates on the electrodes and cap structure during spraying. In an HVLP type spray gun, the air pressure might be as high as 15–25 psig, or even higher, rather than the usual HVLP pressure of 10 psig or less. The exact pressure that can be used will depend on the dimensions of the air cap, the size of the liquid and air orifices, the viscosity of the liquid, and like factors. It should also be understood that gases other than air can be used, if desired, so that where the term air is used hereinafter, it will be understood to include any suitable gas.

BRIEF DESCRIPTION OF THE DRAWINGS

The foregoing and additional objects, features, and advantages of the present invention will become apparent to those of skill in the art from a consideration of the following detailed description of preferred embodiments thereof, taken into conjunction with the accompanying drawings, in which:

FIG. 3 is a cross sectional view of the air cap of FIG. 2, taken along lines 3—3 thereof, and showing one form of connector, utilizing spring wiper arms, between the rotatable cap and the air gun body;

FIG. 4 is an enlarged partial view of the air cap of FIG. 3, illustrating a modified spring wiper arm;

FIG. 5 is a partial sectional view of the air cap of FIG. 3, illustrating a second embodiment of the connector between the air cap and the spray gun body;

FIG. 6 is a perspective view of a spring wiper arm for use in the embodiment of FIG. 5;

FIG. 7 is a perspective view of a modified spring wiper arm for the embodiment of FIG. 5;

FIG. 23 is a diagrammatic illustration of the electric field and the spray pattern produced by the air cap of the present invention;

FIG. 24 illustrates a power supply control for a spray gun utilizing the air cap of the present invention;

FIG. 25 is a diagrammatic illustration of a suitable power supply for use with the air cap of the present invention;

DESCRIPTION OF PREFERRED EMBODIMENTS

Figure 1:
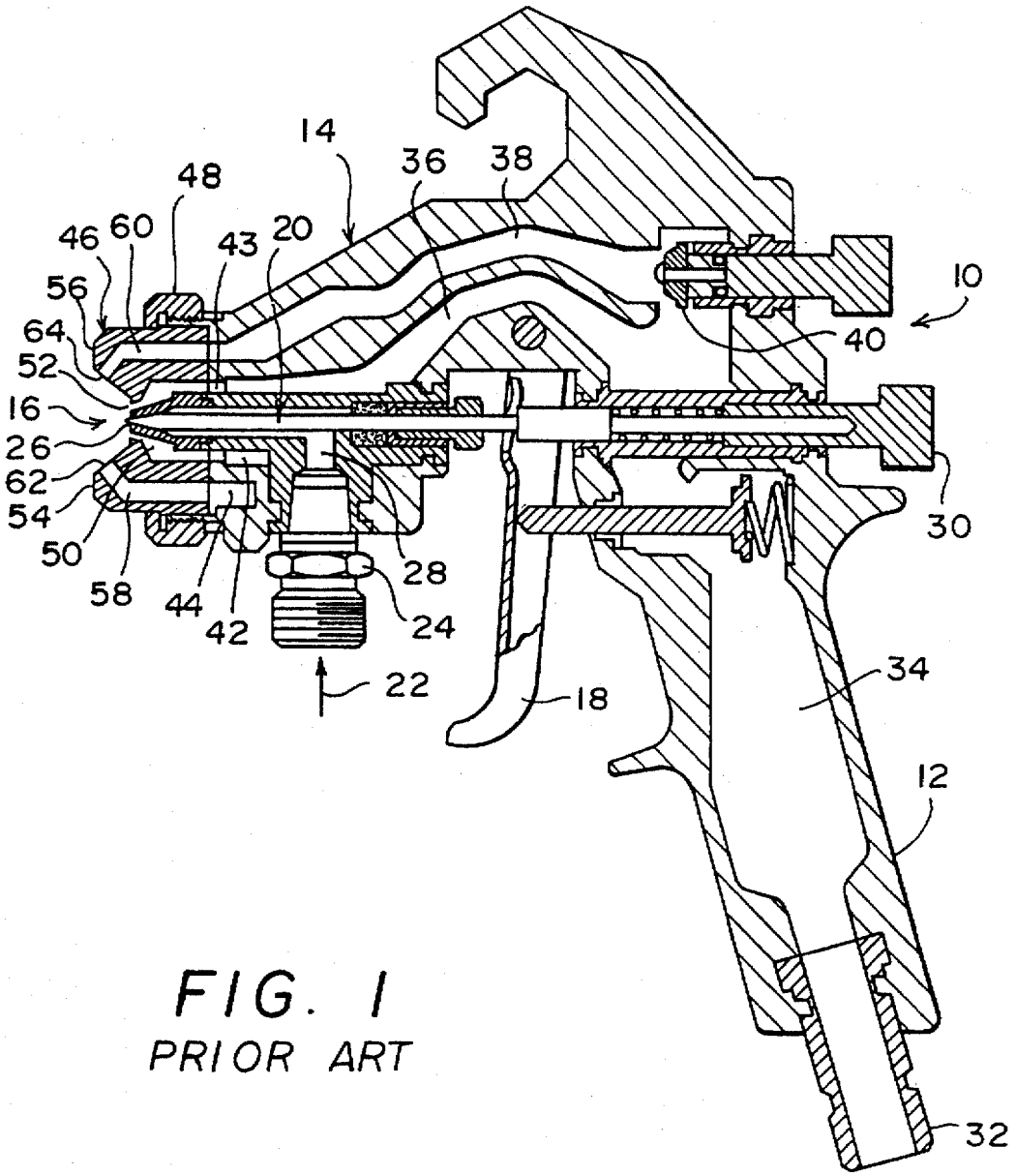
FIG. 1 PRIOR ART
FIG. 1 is a diagrammatic cross sectional view of a conventional hand held fluid spray gun.

Referring now to the drawings and in particular to FIG. 1 there is illustrated at 10 a conventional air-operated spray gun having a handle portion 12, a barrel, or body portion, 14 and a nozzle assembly generally indicated at 16. The illustrated spray gun is a hand held device having a conventional trigger 18 which operates a needle valve assembly 20 which controls the flow of a liquid to be sprayed. This liquid is supplied under pressure as indicated at arrow 22, through a suitable connector 24. The flow control needle valve 20 extends through the spray gun body 14 into the nozzle assembly 16 to regulate the flow of liquid through an exit orifice 26 at the distal end of the nozzle. The liquid to be sprayed, which in one preferred embodiment of the invention is a conductive or semiconductive paint, passes through a passageway 28 around the outside of needle valve 20 and through orifice 26, where it is discharged as an atomized spray of droplets. The location of the needle valve 20 is regulated by a threaded adjuster knob 30, in conventional manner.

A propellant or atomizing fluid such as air or another suitable gas is applied under pressure to the nozzle assembly 16 by way of an air hose connector 32 and an air passageway 34 in the handle of the spray gun. To provide the required degree of atomization and to regulate the discharge pattern of the spray, the air supply is fed to two separate passageways 36 and 38 extending through the body portion 14 of the spray gun. The air flow in passageway 36 is regulated by the pressure of the external air supply, while the air flow in passageway 38 is regulated by a manual control valve 40.

In accordance with known spray gun construction, air flow passageway 36 terminates at the forward end or face, of the body portion 14 in an annular air chamber 42 which extends to the face of the spray gun body portion as an annular air orifice or as a plurality of openings 43 spaced around the nozzle 16 and coaxial with the liquid flow passageway 28. Similarly, passageway 38 terminates at the forward end of the body portion 14 in an annular air chamber 44 which also forms an air exit orifice on the forward face of body portion 14. This exit orifice can be annular or can be a series of openings.

Surrounding the nozzle assembly 16 is an annular air cap 46 which is secured to the spray gun body portion 14 by a retainer nut 48, which is preferably plastic, with the rear face of the air cap engaging the forward face of the body 14. The cap incorporates a central air chamber 50 which receives the forward end, or tip, of the nozzle 16, and engages the air chamber 42 through openings 43. The cap includes an air outlet 52 which surrounds nozzle 16 and is concentric with the exit orifice 26. This outlet 52 cooperates with the nozzle to provide a single continuous annular aperture or may be a series of small apertures spaced around the nozzle, which cooperate to direct air from chamber 42 through the cap in a generally axial direction in such a way as to assist in atomizing the liquid from exit orifice 26.

Extending forwardly from the air cap 46 are a pair of air horns 54 and 56 which contain corresponding air passageways 58 and 60. These passageways engage the annular chamber 44 and direct air from passageway 38 outwardly through air horn exit apertures 62 and 64. The air flow from the air horns is generally radially inwardly toward the liquid spray axis to shape the pattern of the liquid discharge. By regulating the rates of flow of the various streams of liquid and air, and by careful selection of the number and angle of the air exit ports formed in the air cap, a spray discharge having the desired degree of atomization and spray pattern can be produced. Typically, the air horn ports deflect the atomized particles into a fan shape for easy use of the spray gun.

Figure 2:
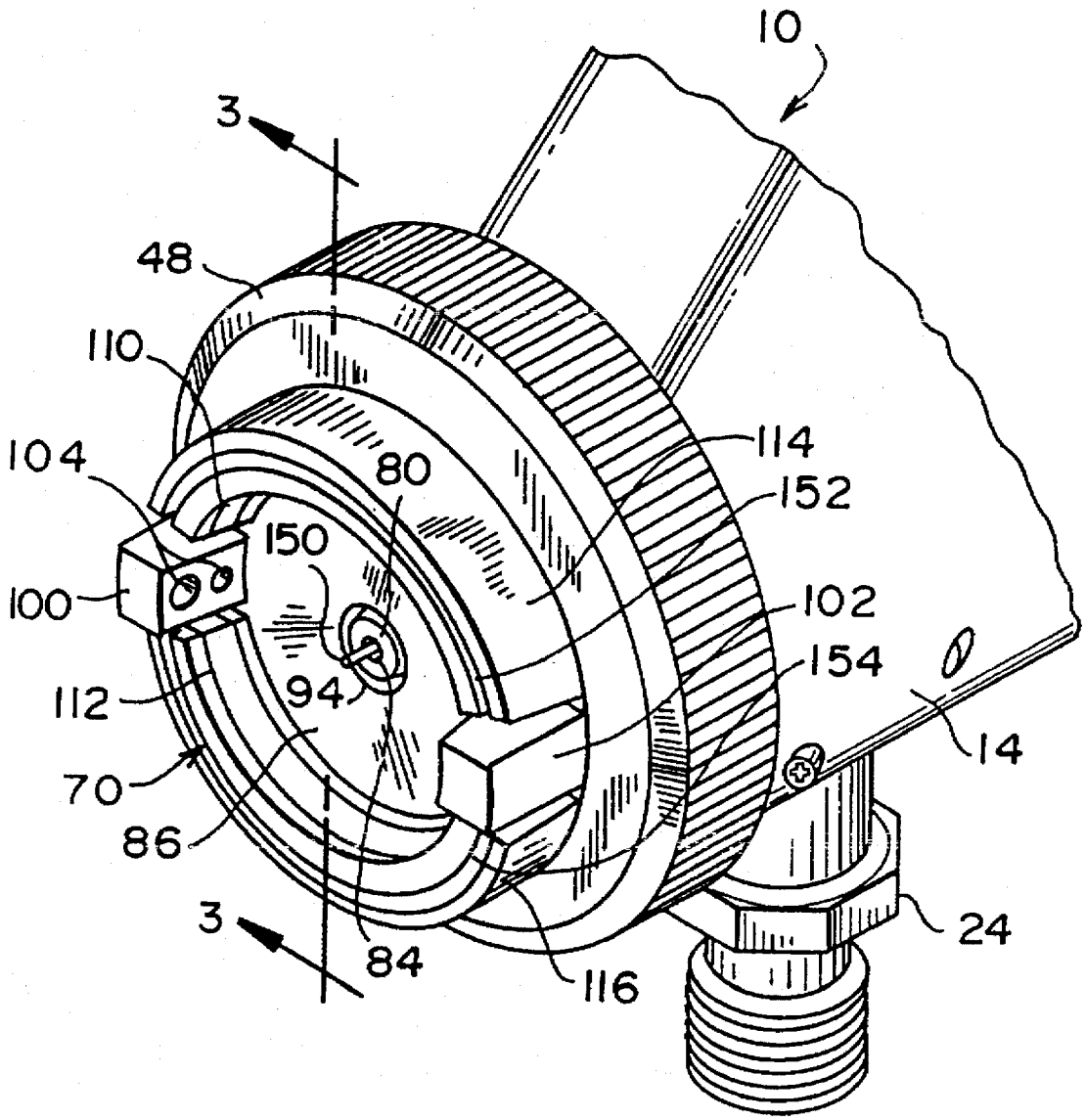
FIG. 2 is an enlarged, perspective, partial view of the air gun of FIG. 1 incorporating the improved induction charging cap of the present invention.

The improved induction charging air cap of the present invention is illustrated in one embodiment in FIGS. 2 and 3, to which reference is now made. The air cap, generally indicated at 70, is annular, and is secured to a conventional spray gun, such as the hand held spray gun 10, by the retainer nut 48 which engages external threads 72 formed on an annular, forwardly extending sleeve portion 74 of the body portion 14. The annular sleeve portion 74 of the body surrounds a face portion 76 of the body 14 and defines a cylindrical receptacle in front of the annular air chambers 42 and 44 and around the spray gun nozzle connected to the central liquid passageway 28, described above with respect to FIG. 1.

The passageway 28 in the spray gun is defined by a cylindrical wall 78 which extends to the face 76 of the spray gun body portion. This passageway wall is extended by a liquid nozzle extension 80 which is threaded to the forward end of wall 78 at 81. The nozzle extension 80 extends the liquid passageway 28 into an interior forwardly and inwardly tapered cavity 82 axially located within air cap 70 to provide a liquid exit orifice 84 at the forward face 86 of the cap. The axially adjustable needle valve 20 extends through the interior of fluid nozzle extension 80, with the tip 88 of needle valve 20 extending into orifice 84 to provide an annular exit passageway for the liquid being sprayed. In conventional manner, axial motion of the needle valve 20 opens and closes the orifice 84 to regulate the fluid flow.

The cap 70 includes an annular rear face 90 which is positioned adjacent the forward face 76 of the spray gun when the cap is secured to the spray gun. The rear face of the cap includes an annular shoulder portion 92 which surrounds the interior tapered cavity 82 and which extends rearwardly to engage the forward face 76 of the spray gun body at a location radially outwardly from the outlet of air chamber 42 so that the chamber 42 opens into the interior cavity 82 of the air cap. The shoulder provides a seal to prevent air from passageway 36 and cavity 42 from flowing radially outwardly and thus prevents intermixing of air from cavity 42 with air from cavity 44. This serves to direct the air from passageway 36 and cavity 42 into the tapered cavity 82 and forwardly through the cap to exit the cap from an annular air exit orifice 94 on the forward face 86 of the air cap, thereby providing a spray droplet flow passage 95 in front of the face 86. The annular orifice 94 surrounds the liquid nozzle extension 80 and thus surrounds the liquid exit orifice 84 to assist in the atomization of liquid being sprayed. Although the exit orifice 94 is illustrated as being annular in shape, it will be understood that it may be in the form of a plurality of orifices spaced around the nozzle extension 80. In addition to orifice 94, a plurality of air holes connected by passages through the air cap to air chamber 42 can be provided on face 86 of the cap to cooperate with orifice 94 in shaping and atomizing the liquid exiting from orifice 94.

Cap 70 preferably includes a pair of diametrically opposed air horns 100 and 102 spaced symmetrically on opposite sides of exit orifice 84. Each air horn includes one or more air outlets 104 (FIG. 2) which are connected by way of interior passageways (not shown in FIGS. 2 or 3) such as the passageways 58 and 60 of FIG. 1. These passageways terminate in air inlet openings (not shown) on the rear face 90 of air cap 70 for communication with the annular air chamber 44. As illustrated in FIG. 3, the face 90 of the air cap is spaced slightly away from the face 76 of the spray gun to provide another chamber 106 between the body 14 and the air cap 70. This chamber 106 provides communication between the air chamber 44 and the passageways 58 and 60 so that air supplied through passageway 38 is directed to the air horn outlets 104. As noted above, the shoulder 92 separates the air chamber 106 from the inner cavity 82 so that the air flow from orifice 94 is independent of the air flow from outlets 104.

The forward surface 86 of cap 70 incorporates a pair of curved electrodes 110 and 112 carried by forwardly extending electrode supports 114 and 116, respectively. These supports may be formed integrally with the cap, or may be separate elements fastened to the cap by, for example, screws or adhesive. In the illustrated embodiment, the air cap is of molded plastic, and the electrode supports are integrally formed therewith. The supports 114 and 116 are fabricated with forwardly and outwardly tapered conical inner surfaces 118 and 120, respectively, these conical surfaces being concentric with the liquid exit orifice 84 and the needle 20, with each electrode support being arcuate and extending substantially continuously between the air horns 100 and 102. The electrodes 110 and 112 are carried on supports 114 and 116 and may be mounted on the respective support surfaces 118 and 120 or may be formed in the electrode supports, as by molding, in the manner illustrated in FIG. 3. Although the electrodes are illustrated as covering only a part of surfaces 118 and 120, it will be understood that they may cover the entire surface, as required to provide the electrode dimensions needed to properly induce charges on the atomized particles. The electrodes preferably are a semiconducting plastic material such as carbon-filled or doped acetal resin and are integrally molded within the supports 114 and 116. The electrodes lie in a common plane which is perpendicular to the axis of the needle 20 and are spaced from the needle sufficiently far to provide the desired inductive charging of fluid particles emitted through the fluid exit orifice 84 around the needle 20.

It will be understood that alternative electrode structures may be used; for example, the electrodes may be a metal or semiconductive coating deposited on the surfaces 118 and 120, or may be a metal foil adhesively mounted on the surface. The latter is less desirable because of the possibility of sparking at the foil edges, and because of the mobility of charges through the material, and accordingly a semiconductive material is preferred.

At least one conductor channel leads from the rear surface 90 of the cap to each of the electrodes 110 and 112 for connection of the electrodes to a suitable electrical power supply. In the embodiment illustrated in FIG. 3, conductor channels 122 and 124 lead to electrodes 110 and 112, respectively, and are filled with an electrically resistive material 125; for example, carbon doped plastic such as acetal resin or epoxy, which contacts the electrodes at one end, and which extends back to the rear surface 90. Mounted in the passageways 122 and 124 are corresponding wiper contacts 126 and 128 which extend rearwardly from the cap 70 and into annular chamber 44. The wiper contacts may be embedded in the resistive material 125 within the channels 122 and 124, may be molded into the plastic material of the cap, may extend through and be soldered to the corresponding electrodes 110 and 112, or may be otherwise secured in any desired way to provide a direct or a resistive electrical path to the electrodes.

The rearwardly-extending free ends of the contacts 126 and 128 are curved to form spring contacts which contact an electrically conductive or semiconductive annular sleeve 130 mounted on the inner wall of air chamber 44 or alternative electrically conductive surfaces mounted in the front portion of body 14. Sleeve 130 is connected by way of line 132 to a suitable power supply (to be described) which may be separate from the air gun or mounted thereon. The power supply provides current to the sleeve or other conductive or semiconductive surface 130 which is transferred by way of wiper contacts 126 and 128 to electrodes 110 and 112 through the resistive material 125 in passageways 122 and 124. The resulting potential on the electrodes 110 and 112 produces an electrostatic field in the region 95 in front of the air cap 70 which field extends into the region of the fluid exit orifice 84 so as to induce charges on fluid particles ejected under pressure from the spray gun.

As illustrated in FIGS. 2 and 3, the air cap 70 is generally cylindrical, with an outer circumferential surface 140 having an outwardly extending shoulder portion 142 which fits within the cylindrical receptacle, or socket formed by the outwardly extending sleeve 74 on the face of the air gun 10. The socket is defined by inner cylindrical wall 144 and receives the air cap 70 for attachment to the air gun. The retainer nut 48 includes a central aperture 146 which slides over the outer wall 140 of the air cap and engages the shoulder portion 142 to secure the air cap in place when the retainer nut is threaded onto the air gun, while leaving air cap rotatable within the socket so that the air horns can be located at any desired annular position. The wiper contacts 126 and 128 maintain electrical connections between the electrodes and the power supply at any angular position and the cooperating shapes of the air and liquid passageways in the cap and in the spray gun maintain a continuous air and liquid flow, so that the spray is undiminished when the cap is rotated.

Although the needle portion 88 terminates at or near the orifice 84, approximately in the plane of the front surface 86 to control the liquid flow, it may be desirable in many cases to provide a needle extension, or probe, indicated at 150 in FIGS. 2 and 3, which may extend forwardly of the front wall 86 by about ¼ inch. This needle extension may be approximately 0.030 inch in diameter, preferably is metal, although it can be made of plastic, and is electrically grounded by virtue of its attachment to the needle valve 20, which is electrically grounded through the spray gun 10 or by direct connection to electrical ground. The probe 150 can be integral with the needle 20, or it can be attached by threads or press fit onto the tip portion 88 of the needle. Operationally, the probe acts to spread the fluid out as it leaves the orifice 84 to provide a more complete interaction with the electrostatic field produced by the electrodes 110 and 112. A secondary function of the probe is to act as a corona source when low conductivity liquids are sprayed. In this situation, the probe 150 would be conductive and sharpened to enhance the corona effect. The probe diameter can vary and will depend on the size of the nozzle orifice so as to preserve the desired liquid flow gap. In general, the size of the probe will vary linearly with changes in the diameter of the liquid flow orifice with a probe diameter of about 0.030 inch being about optimum for an orifice having a diameter of between about 0.050 and 0.060 inch.

The forward faces of the electrode supports 114 and 116 may incorporate one or more grooves 152 and 154 to lengthen any leakage path that may occur between the electrodes 110, 112, and the body of the spray gun, thus reducing leakage currents and preventing unwanted short circuits. A groove 1/16 inch deep by 1/16 inch wide has worked well in one embodiment of the invention. Although a single groove is shown on each electrode support, multiple grooves can be provided to further increase the leakage path, the number of grooves being dependent, to some extent, on the thickness of the forward faces 114 and 116, as well as considerations of manufacturing ease, durability, and ease of cleaning the cap.

The system as described above is very spark resistant because of the inherent small capacitance of the cap, electrodes, and the like. In addition, if the electrodes 110 and 112 are formed of semiconductive material, spark resistance is enhanced. Further spark resistance can be achieved by replacing the semiconductive plastic material 125 within channels 122 and 124 with small fixed high voltage resistors in the range of 100 megohms. Such resistors, in combination with appropriate resistors in the range of about 1 Gigohm in the spray gun body, result in a virtually sparkless system, even with the electrodes at 12 KV.

FIG. 4 illustrates an embodiment wherein the resistive material 125 in channel 122 is replaced by a resistor 160. In this case, the electrode 110 incorporates a connector post 162 which is formed integrally with the electrode and is molded into the plastic air cap, the connector post being conductive or semiconductive and including a spring contact 164 for engaging one end of the resistor 160. The resistor is secured in channel 122 against spring contact 164 by means of a press fit fastener 166 which receives the opposite end of the resistor 160 and which is secured into an enlarged portion 168 of the channel. Also received in an aperture 170 formed in fastener 166 is one end of the wiper contact 126, the contact extending through the aperture to engage the end of resistor 160.

Although the electrodes 110, 112 illustrated in FIGS. 2, 3, and 4 are generally cone-shaped by reason of their location on the generally forwardly and outwardly sloping surfaces 118 and 120, it may be desirable in some applications to fabricate arcuate generally cylindrical electrodes coaxial with the nozzle extension 80 and located on cylindrical surfaces of the air cap or of the electrode supports. In addition, in some applications air horns may not be required for shaping of the liquid spray particles, in which case a single cylindrical electrode coaxial with the axis of the nozzle extension, and with the air cap, can be provided. FIG. 5 illustrates in partial section a modified air cap 180 in which such a single cylindrical electrode 182 is provided on an inner cylindrical surface 183 of the air cap or on a corresponding inner surface of an annular electrode support secured to the air cap.

The cylindrical electrode can be a semiconductive coating or, in the alternative, can be fabricated as a separate element and snapped into place or molded into position on the air cap or on the electrode support. In this embodiment, the electrode 182 is connected to a power supply by way of one or more wires 184 which are connected at one end to the electrode 182 and which extend rearwardly through passageways 186, 188 for connection through a suitable rotatable connector to the power supply. The connector may be fabricated in the manner illustrated with respect to FIG. 3, or may take the modified form illustrated at 189 in FIG. 5. In the embodiment of FIG. 5, the connection between the rotatable cap 180 and the stationary air gun 14 is formed by way of a conductive or semiconductive sleeve 190 on the outer surface of air cap 180. The sleeve 190 may be a coating on the outer surface of the shoulder 192 of the air cap, this shoulder being engaged by the retainer 48 to secure the air cap to the front face of the spray gun in the manner illustrated with respect to FIG. 3. The wire 184 extends through the cap 180 and is connected, as by soldering, to the sleeve 190, as at 194. Alternatively, the sleeve 190 can be made of semiconducting plastic and press fit onto the outer surface of the air cap in physical and electrical contact with wire 184, or the wire can be terminated flush with the cap surface and a semiconductive coating applied to the surface.

In the embodiment of FIG. 5, the connection between the air cap 180 and the spray gun 14 is completed by means of a spring clip 196 mounted on the face of the spray gun 14, one end of the clip extending through an aperture 198 in the face 76 of the spray gun and extending forwardly into a groove 200 on the inner surface 201. When the air cap 180 is drawn up against the face of the air cap 14 by retainer 48 into the socket formed by surface 201, contact is made between the forward end of spring clip 196 and the conductive sleeve 190 for connection to a power supply by way of conductor 202 connected to rearwardly extending free end of spring 196.

Spring 196 may be a formed wire, such as music or "piano" wire, as illustrated at 196' in FIG. 6, or can be sheet metal, as illustrated at 196' in FIG. 7.

The charging electrodes, whether the cone shaped electrodes 110, 112, or the cylindrical electrode 182, are positioned, in a preferred form of the invention, at a perpendicular radius of approximately 0.55 inches from the axis of the spray nozzle 84 in the air cap. The air cap has an outer diameter of approximately 1.5 inches and a front surface 210 (FIGS. 3 or 5) is approximately 0.170 inches in front of the cap face 86. The surface on which the electrode is carried has an active area of approximately 0.587 square inches, reduced by the portion of the surface which is removed to provide for the air horns 100 and 102 and any air gaps between the air horns and the electrode supports 114, 116. This results in an active electrode area of about 0.434 square inches, in one embodiment of the invention. Air caps may be fabricated in a range of sizes to accommodate different spray guns and/or different spray rates, and accordingly the size and spacing of the charging electrodes may also vary. Larger diameter air caps would permit the use of larger diameter electrodes, roughly in the same proportion, and the active electrode area similarly could be varied, roughly in proportion to cap diameter. The electrode area must be made large enough to efficiently charge the liquid being atomized by the spray gun and cap, and if the electrode support is not large enough, the inner surface of the air horns can be used to provide an additional active electrode surface. However, the turbulence produced at the air horn air orifices and the fact that the air horn electrode would become highly attractive to charged particles would tend to produce excessive liquid coating on the air horns. This excess coating build-up during spraying would result in a tendency of the device to "slug;" i.e., to release large drops of accumulated liquid into the spray path, resulting in uneven coating. It should be noted that a minimum electrode size is preferred, since large electrodes block air flow into the spray region, and can also be too attractive to the charged particles. A preferred range of electrode dimensions for a cylindrical electrode would be a radius of 0.3 to 0.7 inch perpendicular to the axis of liquid orifice, with a forward projection, or axial length, of 0.1 to 0.3 inch, producing a minimum active electrode surface area of 0.25 to 1.3 square inches.

In the embodiment of FIG. 5, the inner cylindrical surface which carries electrode 182 tapers inwardly at region 212 at an angle of about 45° from the electrode, and semiconductive material extends onto at least a part of this region for the purpose of making a connection with the wire 184. As also illustrated in FIG. 5, a plurality of apertures 214 can be provided behind the electrode 182 and extending outwardly through the cap as indicated in phantom at 216 to permit ambient air to be aspirated into the flow path of the atomized particles. In addition, or alternatively, a series of notches, indicated at 218, can be cut in the air cap rim to facilitate ambient air flow into the particle flow path, although this reduces the electrode area. Any number of apertures 214 or notches 218 can be provided to accommodate the desired air flow, as long as the required electrode area is maintained. Similar apertures or air flow notches can be provided in the embodiment of FIG. 3, as well. To provide maximum air flow, the electrodes in the air cap of either FIG. 3 or FIG. 5 can be supported by a web structure, if desired.

The conical electrodes carried by surfaces 118 and 120 (FIG. 3) form an angle of about 30° with the spray nozzle axis, in one embodiment of the invention, and provide an electrode surface area which is comparable to that of the cylindrical electrode 182 shown in FIG. 5.

FIGS. 8 through 11 illustrate a third embodiment of the present invention wherein an air cap 220 is mounted on a conventional spray gun, in this case an automatic spray gun generally indicated at 222, in the manner described above, although the retainer 48 is not illustrated in these Figures for simplicity. The air cap 220 is similar to air cap 180 illustrated in FIG. 5, but in this case includes two curved electrodes 224 and 226 mounted on curved electrode supports 228 and 230, respectively secured to the front face 232 of the cap. The electrodes in this case are arcuate and generally semicylindrical and extend rearwardly at 224' and 226' to provide electrical connections through wires 234 and 236 to the connector structure 237 which extends between the relatively rotatable air cap 220 and the relatively stationary spray gun 222. The air cap 220 differs from cap 180 in the provision of a pair of air horns 240, 242 having air outlet apertures 244, 246 connected through corresponding air passageways 248 and 250 (FIG. 10), to engage the annular air supply chamber 252 (FIG. 8) formed at the front face of spray gun 222.

The front surface 254 of the air cap 220 includes grooves 256 and 258 which lengthens the front surface leakage path from the electrodes to the grounded spray gun body, minimizing the possibility of an undesirable voltage reduction when spraying in a humid and/or contaminated atmosphere.

Figure 9:
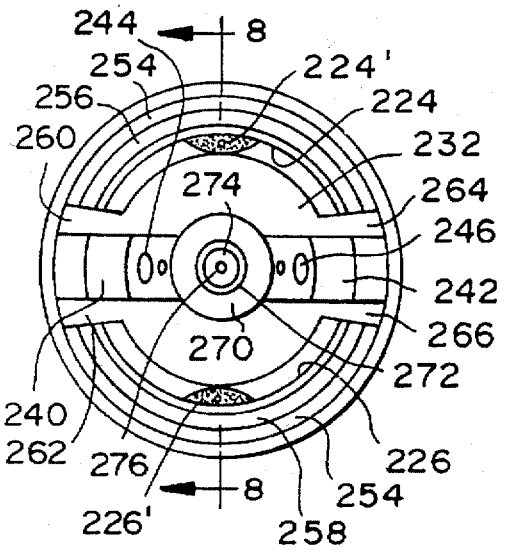
FIG. 9 is a front elevation view taken along lines 9—9 of the air cap of FIG. 8.
Figure 10:
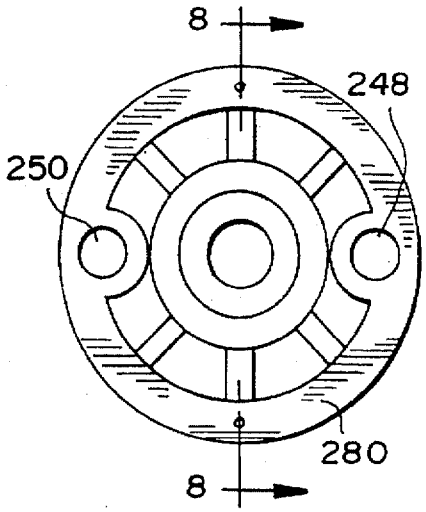
FIG. 10 is a rear elevational view taken along lines 10—10 of the air cap of FIG. 11.
Figure 11:
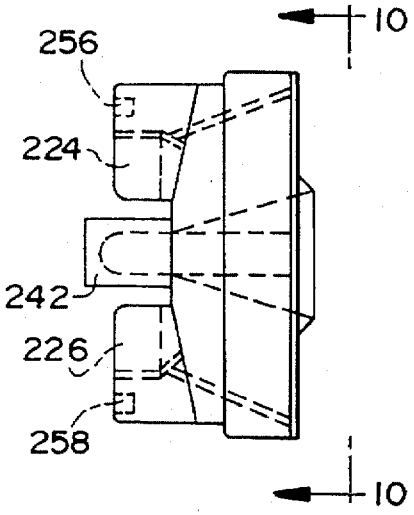
FIG. 11 is a side elevation view of the air cap of FIG. 8.

The curved electrode supports 228 and 230 preferably are nearly semicylindrical, stopping short of the air horns 240 and 242 to provide air flow apertures 260 and 262 on each side of air horn 240, and air flow apertures 264 and 266 on each side of air horn 242 (see FIG. 9). These apertures extend to the exterior surface of the cap to allow external ambient air to be aspirated into the spray zone 95 of the air cap for mixture with the pressurized air and liquid particles produced by the spray gun in order to improve the flow of particles and to reduce turbulence.

The air cap 220 includes a central tapered aperture 270 through which a liquid spray nozzle 272 extends. Liquid to be sprayed is expelled through nozzle aperture 274, with the needle valve 20 extending into the aperture to control the flow rate, as previously described. In the preferred form of the invention, a needle extension probe 276 is also provided, the probe extending through the aperture 274. The spray gun nozzle aperture 274 is surrounded by the tapered air aperture 270, as previously described.

Figure 12:
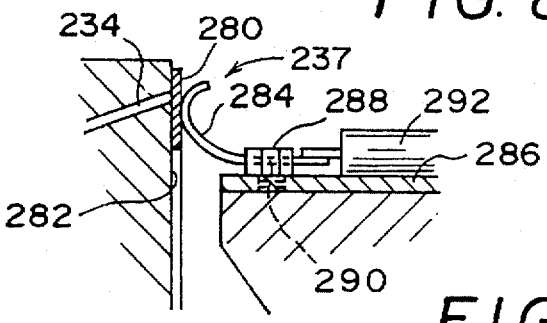
FIG. 12 is an enlarged partial view of the connector spring wiper arm utilized in the embodiment of FIG. 8.

In the embodiment of FIGS. 8–11, the relatively rotatable connector 237 connects the rotatable cap 220 to the power supply carried by spray gun 222. This connector is illustrated in enlarged form in FIG. 12, and includes a conductive ring 280 on the rear surface 282 of cap 220. The ring 280 may be a semiconductive coating or may be a metal or semiconductive plastic ring molded into or snapped into a matching cavity in the rear surface. The ring is connected to wires 234 and 236, as by soldering, to provide electrical connections to the electrodes 224 and 226. A sliding connection is provided by spring wiper contact 284 which may be a wire connected to a nonconductive sleeve 286, for example, by way of a screw 288 having an aperture 290 through which the spring wire 284 extends. The screw is secured in the sleeve 286. Wire 284 may be connected, for example, through suitable control resistors 292 and 293 and wire 294 to a suitable power supply, and a grounding resistor 295 connected between the high voltage power supply and ground may be provided to permit charges on the electrode to bleed to ground when the power supply is turned off.

Figure 13:
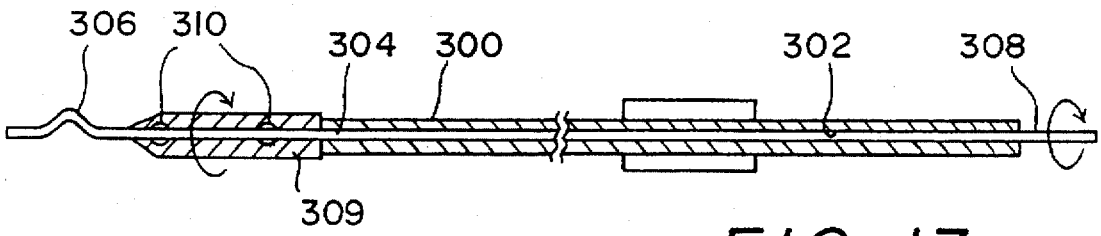
FIG. 13 is an enlarged view of a second embodiment of a flow control needle usable in the air caps of FIGS. 2 through 12.

A modified form of the needle valve 20 utilized in the spray gun discussed above is illustrated in FIG. 13, wherein a needle 300 includes a hollow axial passageway 302 through which a rotatable probe 304 extends. The probe 304 includes at its forward end an offset or paddle portion 306 which will produce a mixing action for the atomized liquid particles which are ejected from the liquid orifice surrounding the needle, such as the orifice 84 in FIG. 3 or 274 in FIG. 8. The mixing action occurs when the probe 304 is rotated, as by an electric or an air driven motor connected to its rearward end 308. The needle probe may be rotated at a few hundred to a few thousand rpm in the liquid stream emerging from the fluid nozzle during spraying, and this tends to spread the fluid and to push the atomizing sites radially outwardly so that they can be more effectively exposed to the electric field supplied by the surrounding induction electrodes, such as the electrodes 224 and 226 in FIG. 8. The effect is to break up and charge the spray droplets more uniformly to increase the charging and deposition efficiency of the system. The drive motor can be mounted internally or externally of the spray gun and can be powered from a low voltage feed from the high voltage supply source in the gun.

The provision of a rotating probe 304 does not adversely affect the valving action of the needle valve 300. This valving action is carried out, for example, by a relatively rotatable tip 309 for needle 300 which is secured to probe 304 by means of flares or flutes such as those illustrated at 310 and which rotates with the probe while needle 300 remains fixed. When the spray gun is switched off (by releasing the trigger 18) the probe drive motor is turned off and tip 309 stops rotating as the needle valve 300 moves axially to close off the liquid flow. Alternatively, tip 309 and needle 300 can be one piece, supported for rotation by bearings.

Figure 14:
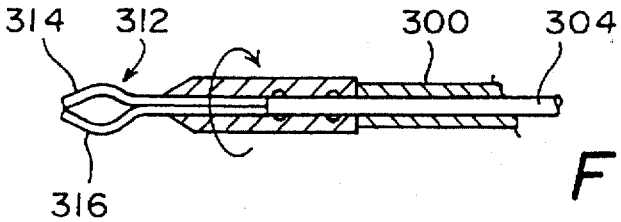
FIG. 14 is a third embodiment of a flow control needle.

The forward end of the probe 304 can take a number of forms to provide the desired mixing action. One alternative is illustrated in FIG. 14, for example, wherein the distal end 312 of the probe is bifurcated to provide a pair of collapsible spring wire paddles 314 and 316. The probes 304 illustrated in FIGS. 13 and 14 have the advantage that they are easily insertable into the fluid nozzle and can be easily withdrawn for cleaning or replacement.

Figure 15:
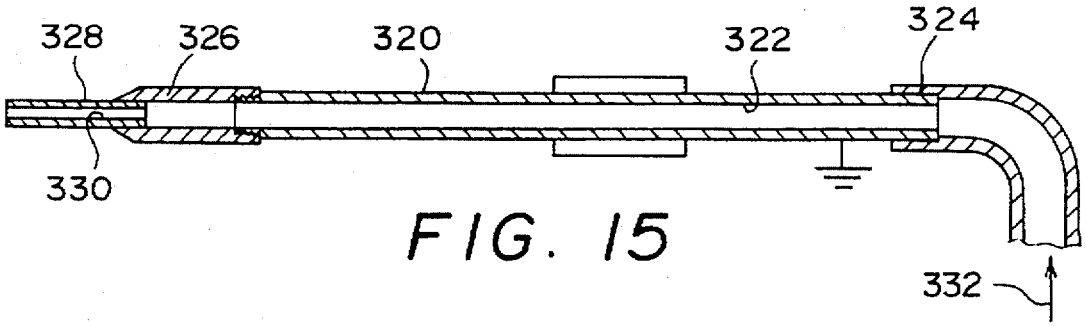
FIG. 15 is a fourth embodiment of a flow control needle for use with the air cap of the present invention.
Figure 16:
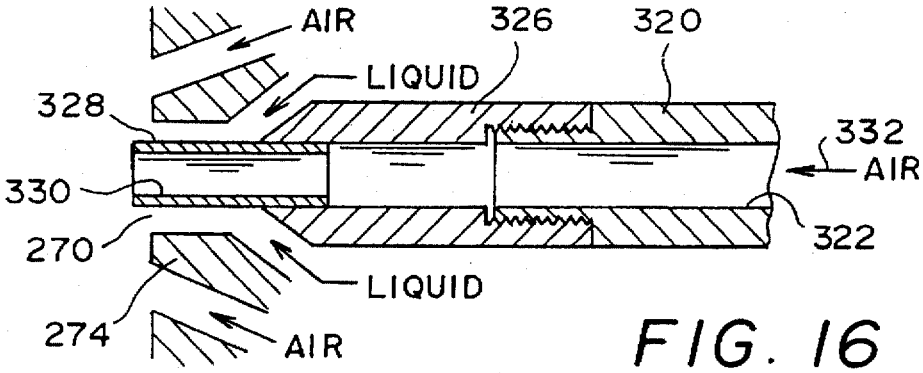
FIG. 16 is an enlarged view of the flow control needle of FIG. 15.

Another form of the control valve needle 20 is illustrated in FIGS. 15 and 16 wherein the needle 320 is hollow, having an axial aperture 322 extending from the rearward end 324 of the needle to the distal end 326. A probe 328 secured to the end of needle 320 is also hollow, having an interior axial aperture 330 aligned with aperture 332. The probe 328 extends through the liquid aperture 270 (FIG. 8) to direct air from a source indicated by arrow 332 into the spray region in front of the nozzle, providing an axial gas stream which forces atomization sites radially outwardly for better exposure to the electrostatic field. This air stream has a high velocity and low volume, compared to the air flow parameters for the spray gun, and thus assists in achieving a more complete droplet charging in the induction field. The internal air stream also acts to more completely break up droplets that are normally larger in the central part of the fluid stream. The probe 328 can be a blunt-tipped metal hypodermic needle tube, and the air supply 322 can be from a separate source outside the spray gun, with its own valve control, or can be tapped from an air passage inside the spray gun.

Figure 17:
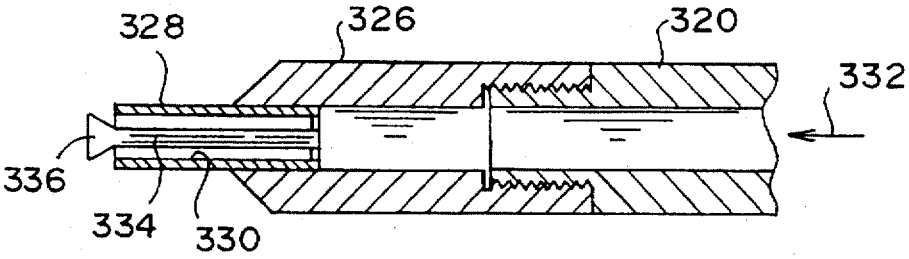
FIG. 17 is an enlarged cross sectional view of a fifth embodiment of the flow control needle of the present invention.

A modification of the device of FIGS. 15 and 16 is illustrated in FIG. 17, wherein the probe 328 incorporates a central diverter 334 having a flared tip 336 which tends to spread the air exiting from the central aperture 330 to provide a greater radial component to the exiting air.

Figure 8:
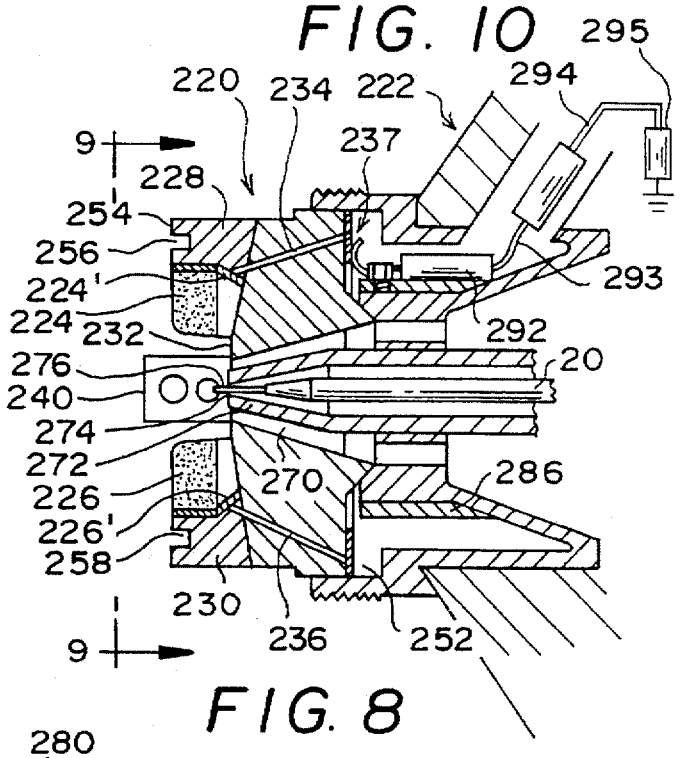
FIG. 8 is a partial cross sectional view of a fourth embodiment of the air cap of the present invention taken along line 8—8 of FIGS. 9 and 10, and illustrating a modified electrode structure and a fourth connector spring wiper arm arrangement.
Figure 18:
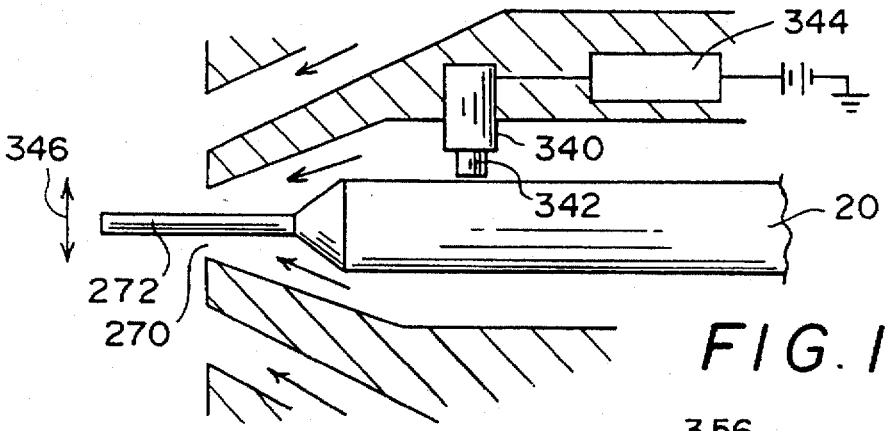
FIG. 18 is an enlarged partial cross sectional view of a sixth embodiment of the fluid flow control nozzle of the present invention.

Another modification of the needle tip is illustrated in FIG. 18, wherein the needle valve 20 carries a probe tip such as the tip 272 illustrated in FIG. 8. In this case, a transverse driver element 340 is positioned close to the needle 20, the driver element having a plunger 342 which engages the side of the needle. Activation of the driver through a suitable driver circuit 344 causes the plunger to be actuated at a rate of up to several thousand Hz, driving the tip transversely and causing the probe 272 to oscillate in the manner indicated by arrow 346. This oscillating movement of the probe 272 assists in breaking up and atomizing the liquid passing through aperture 270 and forces the liquid droplets radially outwardly for improved induction charging. The driving frequency is adjusted to resonance levels for the oscillating probe tip to achieve maximum energy transfer into the atomization process.

In accordance with the invention, the liquid nozzle 80 (FIG. 3) or 274 (FIG. 8) is constructed of a dielectric material such as plastic when the liquid being sprayed is of low conductivity. Plastic has the advantage of somewhat more efficiently concentrating the field lines from the electrodes on the liquid and on the probe. This permits the use of higher applied voltages for better charging of the fluids, and permits the use of corona effects to assist in the charging process. For conductive liquids, such as water-borne and other conductive paints, the nozzle may be conductive; for example metal, since it is more durable and retains its dimensional stability better than plastic.

The forward location of the induction electrodes and their extended surfaces around the circumference of the liquid spray path allows optimal shaping and sizing of the electrodes, as well as positioning of the electrode structure to achieve maximum induction and, when required, corona charging, for an HVLP spray. The structure is consistent with maintenance of a smooth, non-contaminating, aspirated air flow around the spray head and through the apertures 260, 262, 264, and 266 (FIG. 9) as well as through optional apertures 214 and 218, without producing a significant voltage drop on the electrodes due to surface current leakage or arcing to grounded portions of the spray gun, the metal fluid nozzle, or the fluid stream itself. The liquid being sprayed is maintained at or near ground potential, and the electrode system is connected internally, as by way of relatively rotatable components, and by wires, resistors, and/or semiconducting contact surfaces, to a source of charging voltage. This connection permits a sliding contact between the air cap and the spray gun, and thus, in time, permits 360° orientation of the spray fan and incorporation of additional arc and spark suppression resistors close to any potential point of contact.

Figure 19:
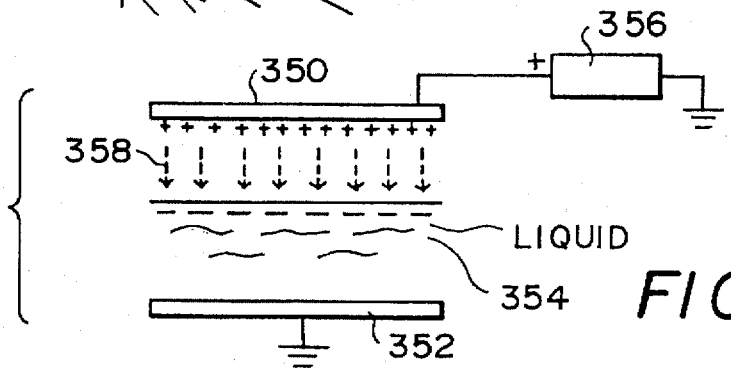
FIGS. 19, 20, 21, and 22 illustrate the process of forming induced charges in particles.

The voltage applied to the induction electrodes, such as electrodes 110, 112 in FIG. 3 and electrodes 224, 226 in FIG. 8 provides inductive charging for conductive liquids and corona charging for nonconductive liquids, the induction charging producing charge droplets having a polarity which is opposite to that of the polarity of the voltage applied to the electrodes. The process of induction charging is illustrated in FIGS. 19–22 wherein the plate 350 represents an induction electrode, and plate 352 represents the ground potential of the control needle valve 20 (or its equivalents) shown in FIGS. 13–18. The liquid being sprayed may be, for example, a conductive liquid such as water-borne paint 354. If a positive voltage is applied to electrode 350, as from a high voltage source 356, an electric field 358 (FIG. 19) is established between the electrode and the surface of liquid 354. The field lines 358 are uniform when the liquid surface is quiescent and in the absence of an air flow between the electrode 350 and the liquid. As illustrated in FIG. 19, this electric field induces at the surface of the liquid a compensating, or image, charge which is of opposite polarity to the charge applied to electrode 350.

Figure 20:
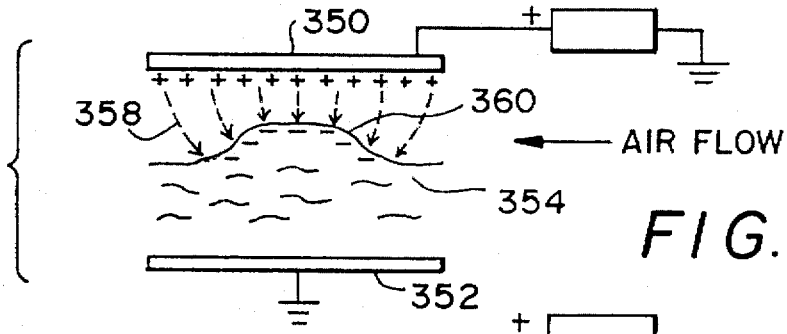
Figure 21:
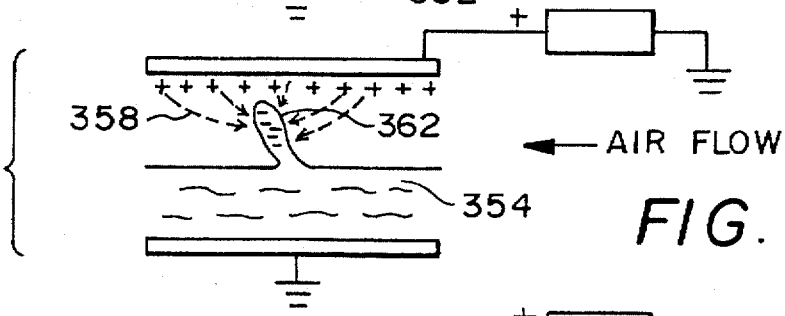

When air starts to flow across the surface of the liquid 354 at a low velocity, a moderate distortion of the fluid surface begins, as illustrated at 360 in FIG. 20, and this distortion causes the negative charges in the liquid surface to begin to concentrate at regions of higher curvature, where the surface of the liquid is closer to electrode 350. This also causes some concentration of the field lines 358. A higher air flow velocity, as indicated in FIG. 21, causes severe distortion of the liquid surface, as indicated at 362, producing a high concentration of negative charges at liquid tips formed on the surface of liquid 354.

Figure 22:
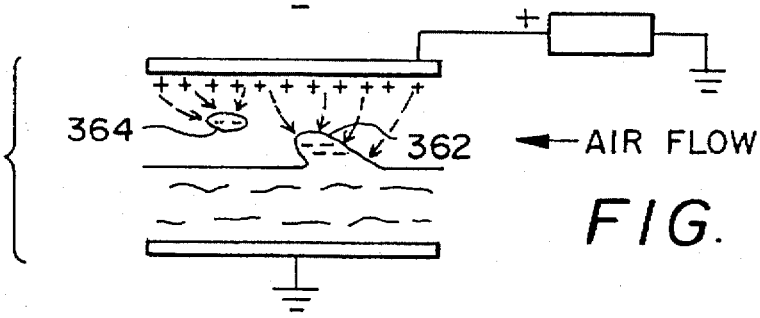

When the air flow increases to a velocity sufficiently high to produce atomization of the liquid, as illustrated in FIG. 22, charged droplets 364 break off of the tips 362 and are eventually blown out of the electrode system. This process results in negatively charged droplets 364 which can then be directed toward a work piece in the manner illustrated in FIG. 23. As there shown, negatively charged droplets 364 are directed by the air flow produced from spray gun 366, which may be any of the spray guns previously described, the air flow directing the droplets toward a work piece 370. This work piece may be grounded and/or electrically nonconductive, with the negatively charged particles producing a spray cloud 372 which effectively coats the work piece. The spray cloud is devoid of unattached gaseous ions such as would be present in a conventional high voltage-generated spray.

If the voltage applied to the electrodes is very high and the liquid being sprayed is very conductive, gaseous ions will be produced at the liquid tips, but these will be attracted to the positive electrode and the spray 372 will still be free of gaseous ions. It is noted that in the illustration of FIGS. 18–22, a positive potential is applied to electrode 350 and the droplets are negative. However, it should be understood that if the applied potential is negative, the droplets will be positively charged. This differs from conventional high voltage air spray painting systems where the fluid is in direct contact with the high voltage needle, and the droplets are charged to the same polarity as the needle. Ions are always present in such systems. It is noted in the illustrations in FIGS. 18–22, that the liquid is presumed to be stationary. However, it will be understood that the liquid can also have a velocity to assist in formation of droplets, without departing from the above theoretical considerations. As illustrated in FIG. 23, a nonuniform electric field produced by the induction electrodes carried by the air cap extends forwardly of the air cap and around the exterior of the cap back to the grounded metal body of the spray gun or to other grounded regions or attachments located behind, but close to, the spray head, thus deflecting the charged liquid droplets and keeping the gun cleaner. Higher applied voltages produce higher fields and more deflecting force. However, higher applied voltages also produce corona off sharp electrode corners and edges, which is undesirable.

The preferred voltage level at the induction charging electrodes is about 10 KV, although it has been found that for charging conductive and semiconductive liquids, a voltage between about 5 KV and 10 KV can be used with good results, and in some cases a range of 2–12 KV can be used. Voltages lower than 2 KV can sometimes produce an acceptable degree of droplet charging, but such voltages require that the electrodes be placed very close to the spray outlet orifice. This increases the risk of contaminating the electrodes with the liquid during prolonged spraying. If a poorly conducting liquid is to be sprayed, corona charging is needed, requiring a voltage of at least 12 KV and preferably 15–20 KV. This voltage is needed to penetrate the combined effects of charged liquid droplets and screening ions to produce the corona effects at a grounded, sharpened needle tip or probe in the center of the spray stream.

If desired, the voltage at electrodes 110, 112 can be optimized automatically for a wide range of liquid conductivities and ambient conditions by employing the control resistor method disclosed in U.S. Pat. No. 4,073,002 (Sickles, et al), and described at columns 5–7 thereof. Thus, for example, a fixed high voltage of about 12 KV is supplied to the electrodes through a total in-line resistance of about 0.1 to 1.0 gigohm/KV. In the case of a 12 KV electrode voltage, the resistance would be in the range of 1.2–12 gigohms. In practice, however, a lower resistance may be desirable to speed the switching response to on-off cycles, although the degree of control is reduced somewhat. Such an increase in switching speed may be particularly desirable for robotic or automatic spray gun applications.

As illustrated in FIG. 24, the spray gun 366 may be connected to a suitable power supply which includes a DC or AC primary source 380 which may produce, for example, ten to twenty volts DC at 500 milliamps. A control box 382 includes an on-off switch 384, an optional battery switch 386, and a potentiometer 388. In addition, a ground jack 390 for a grounding cable may be provided, and a voltmeter 392 is provided to permit selection of the voltage to be supplied to the induction electrode. The output of the control box is supplied by way of lines 394 to a high voltage circuit 396 mounted on or integral with the spray gun 366. The high voltage circuit converts the output from the control box to a voltage typically between 5 and 10 KV for application to the induction electrodes. The on-off switch 384 may incorporate not only a manual switch but a gas (air) flow-sensing switch responsive to gas flow to the spray gun. When the gun 366 is turned off by releasing the spray control trigger, the gas flow is switched off, or at least drastically reduced, and this flow is used to operate the flow-sensing switch and to cut off the power supplied to the gun. Although not shown, it should be understood that control box 380 may be used to power a number of spray guns 366 simultaneously. Also, the high voltage circuit 396 could supply multiple induction spray nozzles on one spray gun 366.

Figure 26:
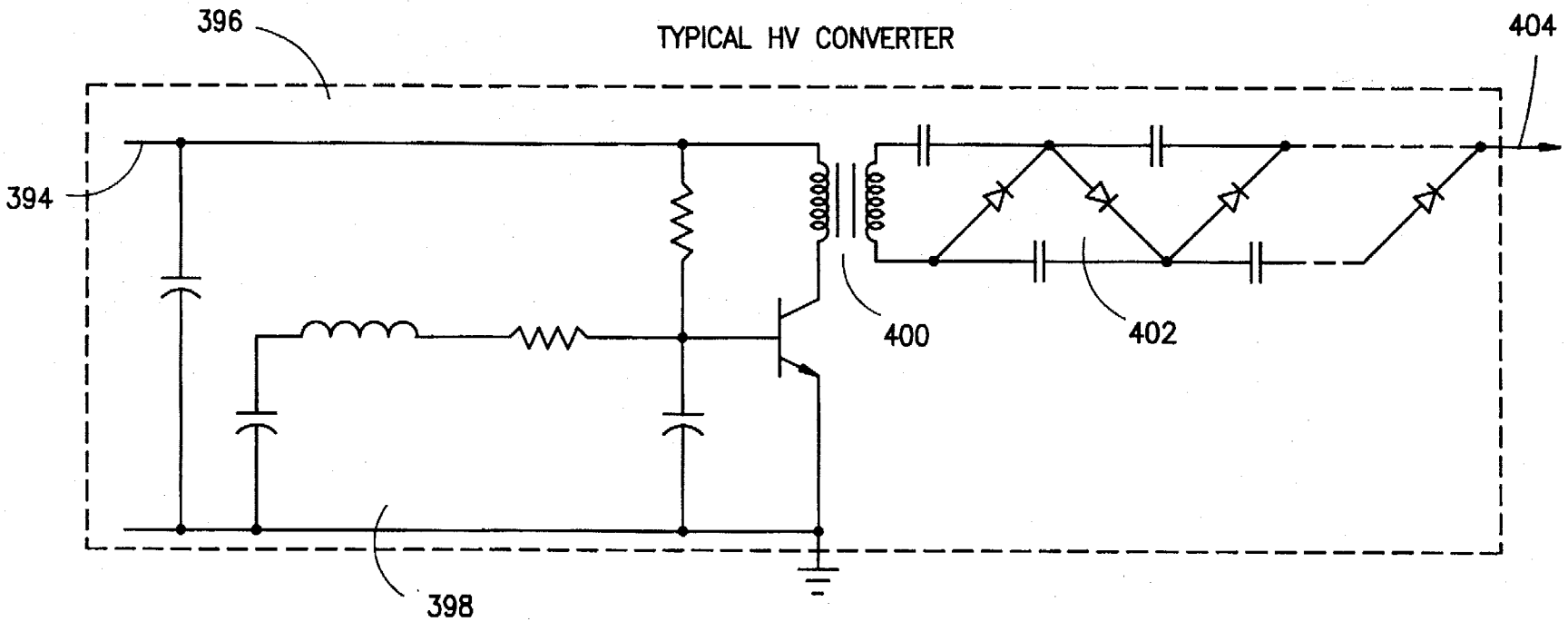
FIG. 26 is a diagrammatic illustration of a high voltage circuit for use with the power supply of FIG. 25.

The high voltage circuit 396 can take several forms, one of which is illustrated in FIG. 26, wherein the DC voltage on line 394 is first converted to AC in oscillator circuit 398 and then is transformed to a high voltage AC by means of high frequency transformer 400. Typically, the high voltage AC signal is further multiplied and converted to DC in a voltage multiplier ladder circuit 402 for supplying DC of either plus or minus polarity to the spray gun electrodes by way of output line 404. Alternatively, the circuit 396 can be a floating power supply capable of providing both polarities, on demand. Such a dual output supply can be cycled between positive and negative voltage levels for special coating situations. For example, it may be desired to provide a number of layers of paint or other coating material on a nonconductive and poorly grounded workpiece, such as untreated plastic. This can be done by providing opposite charges on the spray droplets for alternate passes with the spray gun, first applying a positively charged spray and then applying a negatively charged spray, or vice versa. This results in maximum deposition of charged droplets, with minimum repulsion of incoming spray droplets by the existing layer of coating material on the workpiece. The time for a complete cycle would typically be many seconds, although faster timing cycles (alternating between + and –) could be used to minimize Faraday caging repulsion effects when spraying the inside of cavities in nonconductive parts.

Instead of providing a single power supply, it is possible to incorporate two high voltage circuits, or modules, on the spray gun, one with a positive output and the other with a negative output. The on-off cycles of the two power supplies could then be regulated by appropriate programming circuitry in the control box 382. Another alternative for the power supply is to provide an alternating current signal, typically a sine wave of a few KV amplitude and a frequency of 0.1 kHz to 60 kHz, superimposed on a DC voltage. The DC level would be sufficient to produce inductive charging of droplets, while the AC would improve the conditions for droplet size control and charge distribution.

Figure 27:
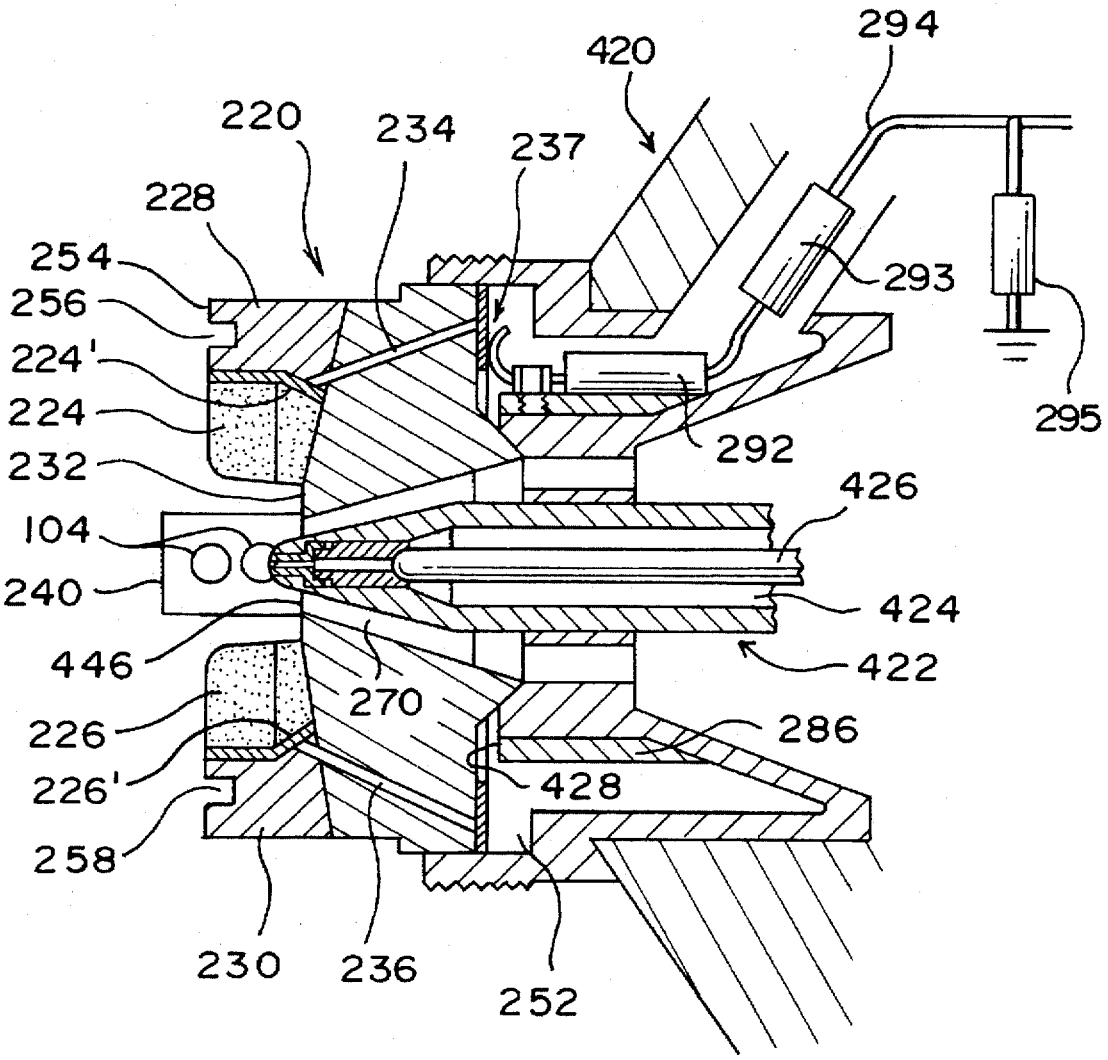
FIG. 27 is a partial cross section of an air cap for an air assisted/airless induction charged nozzle in accordance with the present invention.
Figure 28:
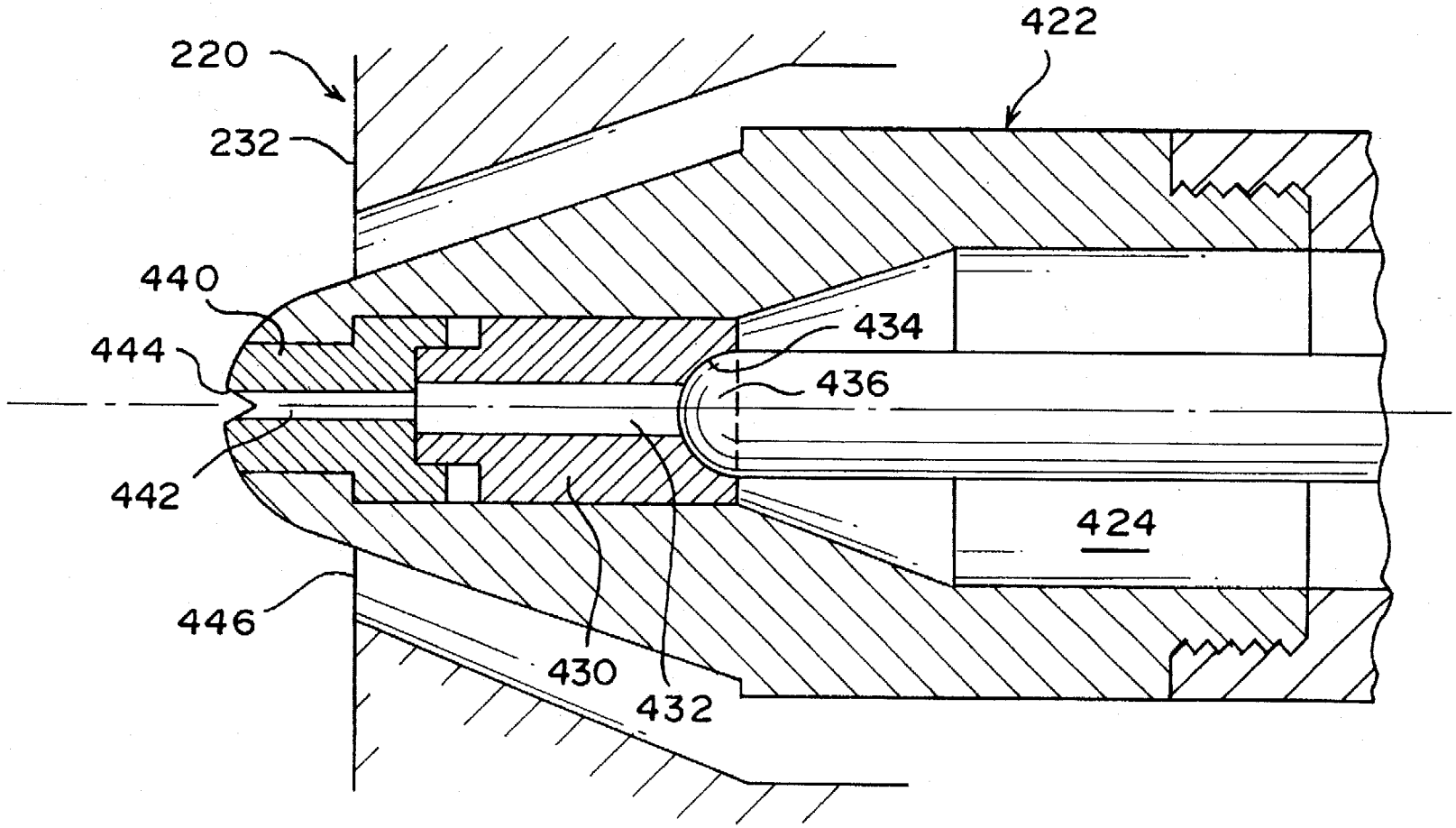
FIG. 28 is an enlarged view of a high pressure fluid nozzle for air assisted/airless operation.

Although the foregoing description illustrates the use of the induction air cap and its induction electrodes in combination with an HVLP system, it will be understood that the several induction caps described above are also usable with other spray gun systems such as, for example, an air-assisted airless spray gun 420, illustrated in FIGS. 27 and 28. The air cap illustrated in these Figures is the air cap 220 described with respect to FIG. 8, and common elements will be similarly numbered. However, the air cap 220 is used for convenience, and it should be understood that the various air cap configuration of FIGS. 3–6 and 9–12 may also be used with the spray gun 420.

In the embodiment of FIGS. 27 and 28, the spray gun 420 incorporates an airless spray nozzle 422 having an axial liquid flow passage 424 in which is a flow control needle valve 426. The nozzle extends forwardly of the face 428 of the spray gun, and is surrounded by the air cap 220, in the manner described with respect to FIG. 8.

The forward end of the nozzle includes a valve seat ring 430 (FIG. 28) mounted in passage 424 and having an axial liquid flow passage 432 which is aligned with passage 424. Ring 430 incorporates at its rearward end a valve seat 434 which receives the forward end 436 of the flow control needle 426. Axial motion of needle 426 opens the passage 432 to the passage 424 through the valve seat 434. Axially aligned with the passages 424 and 432 at the forward and of nozzle 422 is a spray tip 440. The spray tip is mounted in the nozzle passage 424, and includes an axial liquid passage 442 leading to a nozzle spray aperture 444. The passage 442 may have a diameter ranging from a few thousandths of an inch to about 0.045 inch. The selected diameter will depend on the spray fan shape desired, on the viscosity of the liquid to be sprayed, and on the liquid pressure, which may be up to about 1500 psi. The spray tip 440 typically is made from tungsten carbide or other abrasion resistant materials such as hardened steel or a gemstone such as sapphire. The aperture 444 is illustrated as having a transverse tear shape, shown in cross section as a v-cut, to cause sprayed liquid to spread out in a fan. Other aperture shapes can be used to provide desired spray patterns, and impinging air streams can be used to provide additional shaping.

The airless nozzle 422 is surrounded by an air passage 270, having a structure such as that described above with respect to FIG. 8, and which provides an air flow through air cap 220 to one or more air outlet orifices such as orifice 446 in air cap face 232. As illustrated, the outer diameter of the orifice 446 is defined by the air cap, while its inner diameter is defined by the outer surface of the nozzle 422. The air flow from orifice 446 assists in the atomization of the liquid ejected from airless nozzle 422 and such an air-assisted airless nozzle assembly reduces the liquid pressure required to atomize the liquid spray into a uniform spray pattern. Air may be supplied to orifice 446 at a pressure of up to about and 25 psig, or higher, the exact pressure depending on factors such as the viscosity of the liquid being sprayed, the size and exact configuration of the air cap, and the like. The pressure is held at a low enough pressure to prevent excessive turbulence and consequent accumulation of liquid on the electrodes and on the cap.

The air cap 220 is sized to position the electrodes 224 and 226 in alignment with, and generally coplanar with, the spray tip orifice 444, as illustrated in FIG. 27. The electrodes, in the embodiment of the Figure, are extended the full width of the electrode supports 228 and 230 to provide a more uniform field in the spray path. Preferably, the orifice 444 is located so that liquid spray atomizing sites, where the sprayed liquid breaks up into atomized particles, occur between the face 232 of the air cap and the forward face 254 of the electrode supports, preferably where the electric field produced by the voltage applied to the electrodes is at its maximum strength.

The liquid to be sprayed, which may, for example, be a water-based paint, is supplied to the airless nozzle 422 by a liquid pump capable of producing liquid pressures of up to about 1,000–1500 psi. This pressure range is below the 1500 to 3000 psi normally required for airless spray guns because of the air flow provided around the periphery of the nozzle through aperture 446. The air flow assists in atomizing the liquid, permitting a significant reduction in the required liquid pressure, while maintaining the required atomization for developing high average charge to mass ratios on the spray droplets and for improving coating uniformity at the target. The air flow around the nozzle produces some turbulence, and this affects the atomization of the liquid ejected from the nozzle tip. An increase in air flow tends to move the atomization sites back toward the nozzle, while the combined effect of the air flow and the high velocity of the liquid carries the droplets forwardly out of the spray gun. The air orifices are relatively large so that the air flow does not adversely affect atomization but instead enhances it by bringing more air into the process to help carry the droplets being formed. This air flow also helps aspirate ambient air into the interior of the cap to assist in the process of atomization and carrying the particles away from the cap.

The liquid flow is controlled by the flow control needle valve 426, motion of the valve regulating the flow of liquid from passage 424 through passages 432 and 442 and out the tip aperture 444. The air supplied to air outlet 446 preferably is less than about 15 psig; however, if desired smaller air outlets may be used, with the air pressure being increased up to about 20 psig or higher in some cases, depending on the material being sprayed. This allows adequate atomization of the liquid without high air pressure and without the dangerously high liquid pressures often associated with airless spray guns. Air from the air horn apertures 104 is used to shape the spray. The illustrated air-assisted airless nozzle combined with the induction air cap also provides induction charging of droplets and increased application efficiency.

The spray gun structure of the present invention integrates induction electrodes, electrode supports, and high voltage sliding contacts with a high volume, low pressure air cap for improved spray charging. No electrode structure extends forward of the air horns or behind the air cap so that the improved structure is easy to use, replace, and clean, is low in manufacturing costs, is compact, reliable, and durable, and has very low capacitance so that problems due to sparking and arcing are reduced. The device includes built-in electrical resistance paths to the induction electrode to impede charge transfer and further reduce sparking and arcing, and has no protruding high voltage contacts that can be damaged in use. The air cap can be rotated 360° so that the operator can select the spray fan angle best adapted for coating specific work pieces, and the air cap of the invention is interchangeable between hand guns and automatic guns, whether HVLP or air-assisted airless, saving manufacturing expense and providing reduced liquid pressures and increased safety. The air cap combines good aspirated air flow around the spray head with relatively large electrode surface area so that electrostatic spraying of water born materials from electrically grounded containers can be carried out with relative ease. The combination of features provides faster coating in HVLP or air-assisted airless spray guns with significantly better coating uniformity and significantly higher application efficiency. The device permits spraying of paints containing metal flakes and allows good flake control, which is not possible with conventional high voltage systems. Although the invention has been described in terms of preferred embodiments, it will be apparent to those of skill in the art that numerous additional variations can be made without departing from the true spirit and scope thereof, as set forth in the accompanying claims.

What is claimed:

1. A method of spraying and electrostatically charging conductive liquids comprising:

supplying liquid to be sprayed to an airless liquid spray orifice;

shaping said orifice to direct liquid along a spray path in a selected spray pattern;

electrically grounding said liquid;

expelling said liquid through said orifice under pressure sufficiently high to atomize said liquid to produce liquid droplets and to direct said droplets along said path in said selected spray pattern;

locating at least one inductive charging electrode adjacent said spray path;

supplying a voltage having a first polarity to said electrode to produce an electric field in a charging region surrounding said liquid orifice;

supplying a volume of low turbulence air under low pressure to an air orifice surrounding said liquid spray; and directing said air from said air orifice through said charging region to produce an air flow around said liquid spray orifice to assist in said atomization and to carry said liquid droplets away from said liquid spray orifice and through said charging region, said air flow being of sufficiently low turbulence and of sufficient volume to discourage the accumulation of droplets on said charging electrode while enabling said electric field to induce on said droplets a charge having a second polarity.

2. The method of claim 1, further including directing a shaping air flow against said atomized droplets to modify said spray pattern.

3. The method of claim 1, wherein the step of producing an electric field includes supplying a voltage of between about 5 and 12 KV to said at least one electrode.

4. The method of claim 1, wherein supplying a voltage to said electrode includes supplying a voltage that is sufficiently high to produce charges of said second polarity on said liquid droplets in the absence of ionization of air in said charging region.

5. The method of claim 1, wherein the step of supplying a high volume of air includes supplying air at a pressure of less than about 20 psi.

6. The method of claim 5 further including expelling said liquid through said orifice at a pressure of less than about 1,000 psi.

7. An air-assisted airless spray apparatus comprising:

a spray gun;

at least a first air passageway in said gun for delivering air at high volume and low pressure;

at least a first liquid passageway in said gun for delivering liquid to be sprayed at a high pressure;

an air cap mounted on said spray gun for rotation with respect to said spray gun;

an air orifice centrally located in said cap;

a second air passageway in said cap for engaging said first air passageway and for delivering said air through said air orifice to produce a low pressure, low turbulence air flow along a flow path;

a high pressure airless nozzle connected to said first liquid passageway for receiving said liquid to be sprayed and having a forward end extending into said second air passageway;

a spray tip at said nozzle forward end having an outlet orifice for discharging a spray of liquid from said nozzle liquid passageway along said flow path and within said air flow, whereby said air flow provides a low turbulence air envelope around said liquid spray;

a flow control needle valve movable within said nozzle to control the flow of liquid to said liquid outlet orifice, thereby to control the discharge of said liquid;

at least one electrode adjacent said liquid outlet orifice and said flow path; and a voltage source connected to said electrode, said voltage having a first polarity and being sufficiently high to produce an electric field in said flow path which will induce charges having a second polarity on said liquid spray.

8. The apparatus of claim 7, further including a target for receiving said liquid spray, said target being electrically grounded.

9. The apparatus of claim 8, wherein said spray gun and said liquid supplied to said liquid outlet orifice are electrically grounded, said electric field extending from said electrode through said flow path to said grounded spray gun.

10. The apparatus of claim 9, wherein said liquid is electrically conductive.

11. The apparatus of claim 10, wherein said air from said air orifice is directed at a pressure of less than about 20 psi in a direction to cooperate with liquid from said airless nozzle to atomize said liquid flowing from said nozzle to produce said liquid spray.

12. The apparatus of claim 11, wherein said airless nozzle further includes a valve seat cooperating with said flow control needle valve to regulate the flow of high pressure liquid to said spray tip.

13. The apparatus of claim 12, wherein said spray tip outlet orifice is shaped to produce a liquid spray having a selected pattern.

14. The apparatus of claim 13, further including at least a third air passageway in said air cap for shaping said spray pattern.

15. The apparatus of claim 7, further including a grounding resistor for said electrode.

16. The apparatus of claim 7, wherein said voltage source includes a direct current supply source of selected polarity and an alternating current superimposed thereon.

17. The apparatus of claim 7, wherein said first air passageway delivers air through said second passageway to said air orifice at a high volume of between about 5 and 60 cfm and a low pressure of less than about 10 psig, wherein voltage source comprises power supply circuitry providing a voltage of between about 2 and 12 KV to said electrode, and wherein said liquid is supplied to said airless nozzle at a pressure of about 1,000 psi.

18. The apparatus of claim 17, wherein said electrode has an area of between about 0.25 and 1.3 square inches and is radially spaced from said liquid outlet orifice by a distance of about 0.3 to 0.7 inch.

19. The apparatus of claim 18, wherein said electrode includes at least two semicircular electrode elements spaced on diametrically opposite sides of said liquid outlet orifice and surrounding said liquid spray flow path in the region of said liquid outlet orifice.

20. The apparatus of claim 19, wherein said electrode elements are generally semicylindrical.

21. The apparatus of claim 20, wherein said electrodes are generally conical.

22. The apparatus of claim 21, further including air inlet means on said cap for introducing ambient air into said flow path.

23. The apparatus of claim 22, wherein said air inlet means comprises a plurality of openings extending through said cap.

24. An air-assisted airless spray apparatus comprising:

a spray gun;

at least a first air passageway in said gun for delivering air at high volume and low pressure;

at least a first liquid passageway in said gun for delivering liquid to be sprayed at a high pressure;

an air cap mounted on said spray bun for rotation with respect to said spray gun;

an air orifice centrally located in said cap;

a second air passageway in said cap for engaging said first air passageway and for delivering said air to said first air orifice;

a high pressure airless nozzle connected to said first liquid passageway for receiving liquid and having a forward end extending into said second air passageway;

a spray tip at said nozzle forward end having an outlet orifice for discharging a liquid spray from said nozzle liquid passageway along a flow path;

a flow control needle valve movable within said nozzle to control the flow of liquid to said liquid outlet orifice, thereby to control the discharge of said liquid;

an electrode adjacent and concentric with said liquid outlet orifice and said flow path;

a voltage source connected to said electrode, said voltage having a first polarity and being sufficiently high to produce an electric field in said flow path which will induce charges having a second polarity on said liquid spray, and being insufficient to produce gaseous ionization; and a rotatable electrical connector between said spray gun and said cap for maintaining an electrical connection therebetween at any rotational angle of said cap to thereby connect said voltage source to said electrode.

25. The apparatus of claim 24, wherein said rotatable connector includes spring contact means on one of said spray gun and said cap and an annular contact on the other of said spray gun and cap, said spring contact means engaging said annular contact.

26. The apparatus of claim 25, further including a resistor connected between said source and said electrode.

27. The apparatus of claim 24, further including a target for receiving said liquid spray, said target being electrically grounded.

28. The apparatus of claim 27, wherein said spray gun and said liquid supplied to said liquid outlet orifice are electrically grounded, said electric field extending from said electrode through said flow path to said grounded spray gun.

29. The apparatus of claim 28, wherein said liquid is electrically conductive.

30. The apparatus of claim 29, wherein said air from said air orifice cooperates with liquid from said airless nozzle to atomize said liquid flowing from said nozzle to produce said liquid spray.

31. The apparatus of claim 30, wherein said airless nozzle further includes a valve seat cooperating with said flow control needle valve to regulate the flow of high pressure liquid to said spray tip.

32. The apparatus of claim 31, wherein said spray tip outlet orifice is shaped to produce a liquid spray having a selected pattern.

33. The apparatus of claim 32, further including at least a third air passageway in said air cap for shaping said spray pattern.

34. Spray gun apparatus comprising:

a spray gun liquid nozzle having an orifice;

an induction air cap body portion having a front face, a rear face, and an outer surface therebetween;

an axial opening extending through said cap body portion for receiving said spray gun nozzle;

means directing liquid to be sprayed through said nozzle orifice;

means directing atomizing air through said axial opening around said spray gun liquid nozzle;

at least one curved electrode support on said cap front face adjacent said nozzle orifice, said electrode support having an inner surface spaced radially from said orifice;

electrode means on said electrode support inner surface;

a rotatable connector having a first component on said air cap body portion for engaging a corresponding second rotatable connector component on said spray gun for providing a rotatable electrical connection between a power supply and said air cap body;

means including a control resistance electrically connecting said power supply through said rotatable connector to said electrode means for supplying a charging voltage to said electrode means, whereby charges are induced on sprayed liquid from said spray nozzle.

35. The spray gun of claim 34, wherein said at least one electrode support includes plural curved electrode supports spaced around and coaxial with said spray nozzle orifice, each said electrode support carrying at least one corresponding electrode.

36. The spray gun of claim 35, wherein each of said plural electrode supports is spaced apart from a next adjacent electrode to produce an ambient air inlet.

37. The spray gun of claim 35, further including a plurality of air inlets extending through said electrode supports.

38. The spray gun of claim 34, wherein said liquid nozzle is an airless nozzle for receiving a liquid under a pressure of less than about 1500 psi to produce an atomized liquid spray.

39. The spray gun of claim 38, wherein said atomizing air is supplied to said axial opening under pressure of less than about 25 psi.

40. The spray gun of claim 34, wherein said control resistor has a value of 0.1 to 1.0 gigohm per 1000 volts of said charging voltage supplied by said power supply.

41. The spray gun of claim 34, further including a high resistance grounding resistor connected to ground to discharge said electrode when the power supply is turned off.

* * * * *